US007460821B2

(12) United States Patent
Ai et al.

(10) Patent No.: US 7,460,821 B2
(45) Date of Patent: Dec. 2, 2008

(54) IMAGE HEATING APPARATUS INCLUDING HEATING ROTATABLE MEMBER AND COOPERATING RUBBING ROTATABLE MEMBER

(75) Inventors: Ryuta Ai, Toride (JP); Yoshikuni Ito, Tokyo (JP); Toshinori Nakayama, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/750,777

(22) Filed: May 18, 2007

(65) Prior Publication Data

US 2008/0038026 A1 Feb. 14, 2008

(30) Foreign Application Priority Data

Aug. 9, 2006 (JP) ..... 2006-217595

(51) Int. Cl.
*G03G 15/20* (2006.01)

(52) U.S. Cl. ..... 399/328; 399/333

(58) Field of Classification Search ..... 399/328–333
See application file for complete search history.

(56) References Cited

U.S. PATENT DOCUMENTS

| | | | | |
|---|---|---|---|---|
| 7,260,351 | B2 | 8/2007 | Nakayama | 399/320 |
| 7,263,303 | B2 | 8/2007 | Nakayama | 399/68 |
| 2005/0185978 | A1 * | 8/2005 | Kemmochi | 399/69 |
| 2006/0083567 | A1 | 4/2006 | Ito et al. | 399/400 |
| 2006/0245798 | A1 | 11/2006 | Nakayama | 399/329 |
| 2007/0053714 | A1 * | 3/2007 | Kuntz et al. | 399/109 |
| 2007/0059009 | A1 | 3/2007 | Nakayama | 399/69 |
| 2007/0212131 | A1 | 9/2007 | Nakayama | 399/323 |
| 2007/0217803 | A1 | 9/2007 | Nakayama | 399/68 |
| 2008/0038027 | A1 * | 2/2008 | Ito et al. | 399/328 |

FOREIGN PATENT DOCUMENTS

| | | | |
|---|---|---|---|
| JP | 2-266383 | | 10/1990 |
| JP | 4-213482 | | 8/1992 |
| JP | 7-89257 | | 9/1995 |
| JP | 2004205991 | A * | 7/2004 |
| JP | 2004-287152 | | 10/2004 |

* cited by examiner

*Primary Examiner*—Ryan Gleitz
(74) *Attorney, Agent, or Firm*—Fitzpatrick, Cella, Harper & Scinto

(57) ABSTRACT

An image heating apparatus includes a heating rotatable member for heating an image on a recording material in a nip, a nip forming member for cooperating with the heating rotatable member to form the nip, and a rubbing rotatable member. The rubbing rotatable member rubs, by its rotation, the heating rotatable member. The rubbing rotatable member has an elastic layer to provide a microhardness [GPa] of not less than 0.03 and not more than 1.0.

6 Claims, 9 Drawing Sheets

IMAGE HEATING APPARATUS INCLUDING HEATING ROTATABLE MEMBER AND COOPERATING RUBBING ROTATABLE MEMBER

FIELD OF THE INVENTION

The present invention relates to an image heating device for heating a toner image on a recording material. As for such an image heating device, there are a fixing device for fixing by heating an unfixed toner image on the recording material, a glossiness improvement device for improving a glossiness of an image by heating a toner image fixed on the recording material, and so on. This image heating device can be used for an image forming apparatuses using an electrophotographic type process, such as a copying machine, a printer and a facsimile machine.

RELATED ART

In the image forming apparatus using the electrophotographic type and so on, the fixing device is used in order to fix the image formed on the recording material by the toner on the recording material. As for such a fixing device, the fixing device of a roller pair type using a fixing roller and a pressing roller is used the widely.

Recently, an oil-less fixing device which uses, for an image formation, the toner which contains parting material is used widely. This oil-less fixing device includes the fixing roller which has an elastic layer and a parting layer laminated on the core metal. The parting layer comprises the material having a excellent parting properties, such as fluorinated resin material, and the use is made with a tube having a excellent parting property in the surface.

Recently, demand for a high-glossiness image formation not having a glossiness non-uniformity increases, and, in order to attain this, above described oil-less fixing device is preferable.

However, in order to form a high-glossiness image not having the glossiness non-uniformity, the problem insignificant in the past is important. In other words, it turned out that an unsmoothness provided by the usage of the surface of the fixing roller has large influence. This will be described in detail.

The most remarkable one among the factors influential to the state of the surface of the fixing roller is the flash formed on the edge around the recording material by a cutting step carried out during the manufacturing of the recording material. The sizes of this flash differ depending on the kind of recording material, but the sizes of the large flash are several micrometers—about ten micrometers.

As shown in FIG. 11, when the recording material having such the flash is nipped and fed by the fixing roller 1 and a pressing roller 2, this flash provides minute recesses on the surface of the fixing roller.

Particularly, when the recording materials of the same width are continuously supplied to the fixing device, the damage of the fixing roller is the maximum.

As a result, the deep and large scratches (unsmoothness or pits and projections) are continuously formed on the portion of the fixing roller (a III region of the in FIG. 9(*a*)) contacted to the flash of the recording material. On the other hand, the scratches attributable to such the flash are not formed on the portion of the fixing roller (I of the in FIG. 9(*a*), II region) not contacted to the flash of the recording material. FIG. 9 shows the surface roughness Rz of the fixing roller after the fixing process of the recording material of a small size (in the case of the longitudinal feeding of A4 size paper) is carried out continuously.

As shown in this Figure, when the fixing process is given to the recording material of a large size by the state having local deep scratches, the gloss of the fixed image is uneven and therefore, the image quality degrade. More specifically, the deep scratches attributable to the flash appear in the fixed image, and, a part of fixed image thereof is unsmooth. As a result, the gloss of the fixed image reduces partially to a great extent.

As shown in FIG. 12, the deep scratches attributable to the flash extend over the entire circumference of the fixing roller, and therefore, the low gloss portion is continuously formed on the image.

In this manner, when the states of the unsmoothness of the surface of the fixing roller differ locally, the state of the unsmoothness of the surface of this fixing roller is reflected on the toner layer.

In other words, in order to form the high-glossiness and high quality image, a stable maintenance of the state of the surface of the fixing roller is desirable.

Japanese Patent Application Publication Hei 7-89257, Japanese Laid-open Patent Application Hei 2-266383, and Japanese Laid-open Patent Application Hei 4-213482 disclose the fixing devices, wherein fixing roller is ground by a cleaning web (nickel-plated web). Here, there is the intention to remove the contamination from the surface of the fixing roller by abrasion with such the cleaning web.

However, in the reference stated above, the surface of the fixing roller is scraped and the new surface is exposed, and therefore, the lifetime reduction of the fixing roller is unavoidable. Particularly, when the fixing roller provided with the parting layers, such as the fluorinated resin material, on the surface is ground by such a method, the parting function is spoiled, and at the time of the subsequent fixing process, the toner offsets to the fixing roller and the fixing defect occur(s). As a result, the frequent exchange of the fixing roller is needed.

In all of the structures disclosed in the prior art, if foreign matter such as paper dust is nipped in the abrading portion, the fixing roller may be damaged by sharp and deep scratches.

SUMMARY OF THE INVENTION

The object of the present invention is to provide an image heating devices, such as the fixing device, which can suppress production of a glossiness non-uniformity on the image, even if foreign matter is introduced into the nip between the heating rotatable member and the rubbing rotatable member.

According to an aspect of the present invention, there is provided an image heating apparatus comprising a heating rotatable member for heating an image on a recording material in a nip; a nip forming member for cooperating with said heating rotatable member to form the nip; a rubbing rotatable member for rubbing, by its rotation, said heating rotatable member; wherein said rubbing rotatable member has an elastic layer to provide a microhardness the GPa] of not less than 0.03 and not more than 1.0.

While the invention has been described with reference to the structures disclosed herein, it is not confined to the details set forth, and this application is intended to cover such modification or changes as may come within the purposes of the improvements or the scope of the following claims.

DESCRIPTION OF THE PREFERRED EMBODIMENTS

Figure 1:
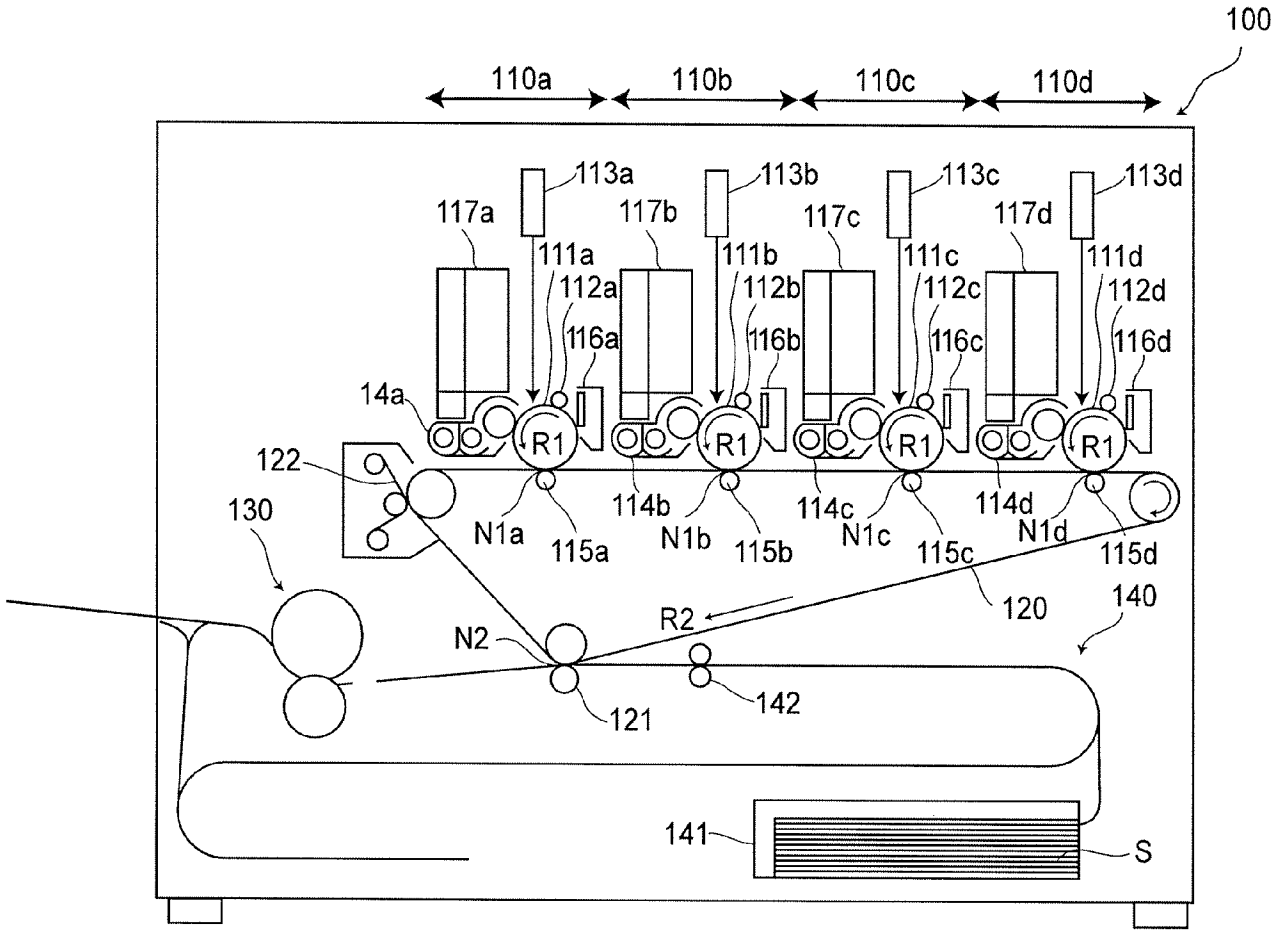
FIG. 1 is a schematic sectional view of an image forming apparatus to which an image heating device according to the present invention is applicable.

An image heating device according to the present invention will be described in detail in conjunction with the drawing.

Embodiment 1

In this example, the image heating device is the fixing device for fixing a toner image of the unfixed formed on a recording material. Before the description of this fixing device, an image forming station of an image forming apparatus will first be described.

(Image Forming Apparatus)

FIG. 1 is a schematic sectional view of the image forming apparatus. An image forming apparatus 100 according to this embodiment is a full-color laser beam printer of the electrophotographic type. In the device, first, second, third, and fourth image forming stations 110*a*-110*d* are juxtaposed. In each of the image forming stations 110*a*-110*d*, the toner image of the different color is formed through a process of a latent image formation, a development, and a transferring.

Each of the image forming stations 110*a*-110*d* is provided with an electrophotographic photosensitive member 111*a*-111*d* of a drum type, i.e., a photosensitive drum, as an image bearing member. Each photosensitive drum 111*a*-111*d* is rotated in the direction of an arrow R1, at a predetermined surface movement speed (peripheral speed), in the Figure. A color toner images is formed on the photosensitive drum 111*a*-111*d*. An intermediary transfer belt 120 as an intermediary transfer member is provided adjacent each photosensitive drum 111*a*-111*d*. The color toner image formed on each photosensitive drum 111*a*-111*d* is transferred primarily onto the intermediary transfer belt 120 in a primary transfer portion N1 a-N 1*d*, and it is transferred secondarily onto a recording material S in the secondary transfer portion N2. The recording material S onto which the toner images are transferred is fed into the inside of the fixing device 130. By heating and pressing the recording material S in the fixing device 130, the toner image is fixed on the recording material S. Thereafter, the recording material S is discharged to the outside of the device as a recorded image.

In each of the image forming stations 110*a*-110*d*, a charging rollers 112*a*-112*d* as charging means and a developing devices 114*a*-114*d* as developing means are disposed around the photosensitive drum 111*a*-111*d*. Around each photosensitive drum 111*a*-111*d*, a primary transfer roller 115*a*-115*d* as primary charging means and a cleaner 116*a*-116*d* as cleaning means are provided. In addition, above each photosensitive drum 111*a*-111*d*, in the Figure, a laser scanner 113*a*-113*d* as exposure means provided with a light source device and a polygonal mirror, are provided.

The photosensitive drum 111*a*-111*d* is substantially uniformly charged by the charging rollers 112*a*-112*d*. In the laser scanner 113*a*-113*d*, a drum is scanned by the polygonal mirror with a laser beam emitted from a light source device rotates. The beam of the scanning light is deflected by the reflection mirror and focussed on the peripheral surface of 111*a*111*d* of a photosensitive drums by the fθ lens. In this way, by exposing the photosensitive drum 111*a*-111*d*, an electrostatic image (latent image) according to the image signal is formed on the photosensitive drum 111*a*-111*d*.

In each developing device 114*a*-114*d*, the toner of each of the yellow color, the magenta color, the cyan color, and the black color is filled as a predetermined amount of a developer. The toner is suitably supplied by a supplying device 117*a*-117*d* into each developing device 114*a*-114*d*. Each developing device 114*a*-114*d* visualize the latent image on the photosensitive drum 111*a*-111*d* into a yellow toner image, a magenta toner image, a cyan toner image, or a black toner image, respectively.

The intermediary transfer belt 120 is rotated in the direction of arrow R2 in the Figure at the surface movement speed (peripheral speed) which is the same as that of the photosensitive drum 111*a*-111*d*.

For example, at the time of full color image formation, a first color (yellow) toner image is first formed on the photosensitive drum 111*a*, and it is carried on the drum surface. The photosensitive drum 111*a* and the intermediary transfer belt 120 contact relative to each other to form a nip (primary transfer portion) N1*a*. When the yellow toner image passes this nip, it is transferred onto an outer surface of the intermediary transfer belt 120 (primary transfer). At this time, a primary transfer bias voltage is applied to the intermediary transfer belt 120 through the primary transfer roller 115*a*, and the toner image is transferred onto the intermediary transfer belt 120 from the photosensitive drum 111*a* by the electric field formed by this primary transfer bias voltage and the pressure.

Similarly, the second color magenta toner image, the third color cyan toner image, and the fourth color black toner image are transferred superimposingly on the intermediary transfer belt 120 sequentially, so that a composite color toner image corresponding to the intended color image is formed.

In the secondary transfer portion N2, the secondary transfer roller 121 as the secondary transfer means is supported in parallel with the intermediary transfer belt 120. In the Figure, the secondary transfer roller 121 is contacted to a lower surface portion of the intermediary transfer belt 120. To the secondary transfer roller 121, the predetermined secondary transfer bias voltage is applied by the secondary transfer bias voltage source.

On the other hand, in recording material supplying means 140, the recording material S is supplied from a sheet feeding cassette 141 through a registration roller 142, a pre-guide (unshown) of the transferring, and so on. The intermediary transfer belt 120 and the secondary transfer roller 121 contact relative to each other to form a nip (secondary transfer portion) N2. Recording material S is fed at predetermined timing through this nip. Simultaneously, the secondary transfer bias voltage is applied to the secondary transfer roller 121 from the secondary transfer bias voltage source. The composite color toner image transferred superimposingly by this secondary transfer bias voltage onto the intermediary transfer belt 120 is transferred onto recording material S from the intermediary transfer member 130 (secondary transfer).

After the primary transfer finishes, the toner (untransferred toner) which remains on each photosensitive drum 111*a*-111*d* is removed and collected with cleaner 116*a*-116*d*. In this way, each photosensitive drums 111*a*-111*d* are cleaned, and it is prepared for the formation of the following latent image. The toner and the other foreign matters which remain on the intermediary transfer belt 120 are wiped off by a cleaning web (nonwoven fabric) 122 contacted to the surface of the intermediary transfer belt 120.

The recording material S carrying the toner image is introduced into the fixing device 130 which will be described hereinafter from the secondary transfer portion N2. In the fixing device 130, the toner image is fixed on the transfer material S by the heat and the pressure being applied to recording material S.

(Fixing Device)

Figure 2:
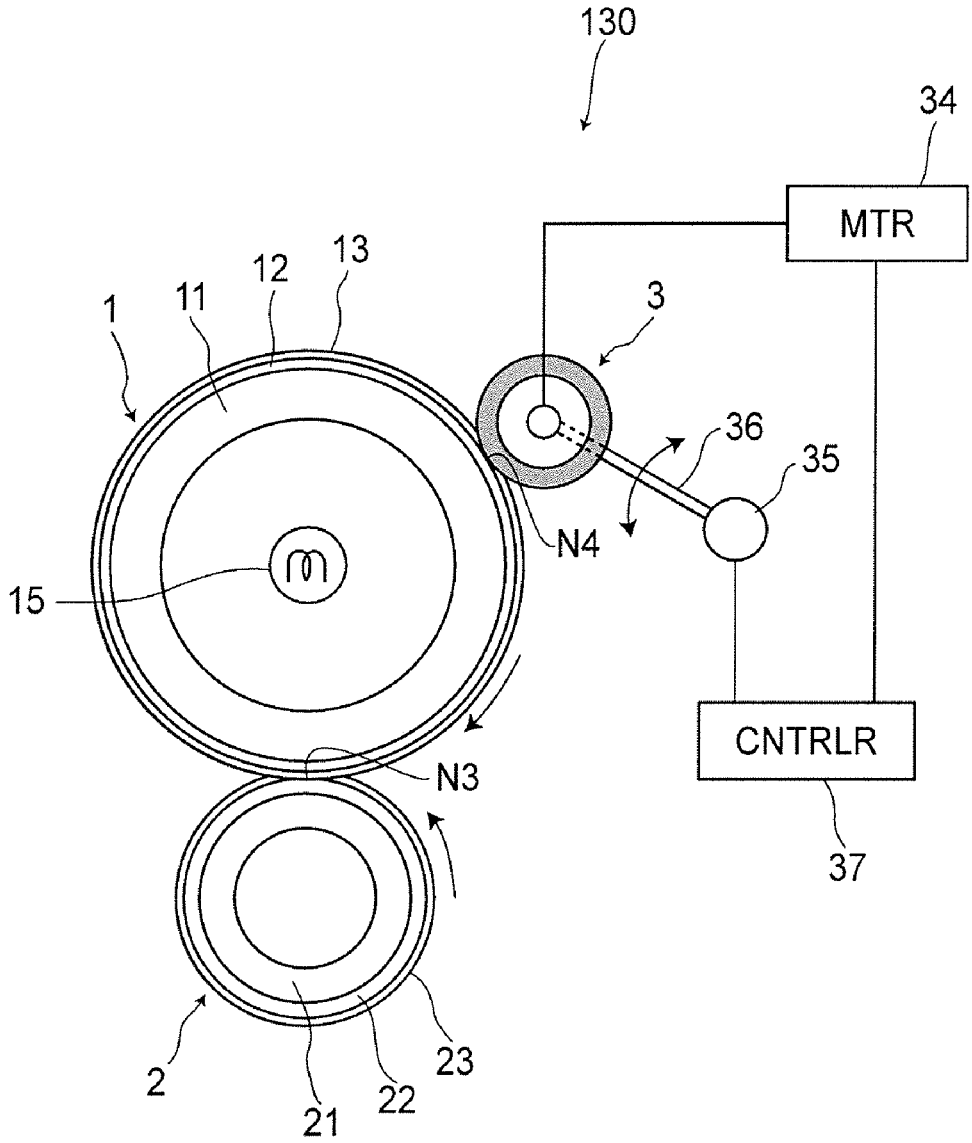
FIG. 2 is a schematic sectional view of the fixing device of an embodiment of the image heating device according to the present invention.

FIG. 2 is a schematic sectional view of an embodiment of the fixing device 130 which is the image heating device according to the present invention. The fixing device 130 comprises the fixing roller (fixing member) 1 as a heating rotatable member for heating the image on recording material S, and a pressing roller (pressing member) 2 as a nip forming rotatable member for forming the nip (fixing nip) N3 in contact to the fixing roller 1. The fixing roller 1 is heated by a heating source 15 provided therein, and, the recording material S carrying the toner image is nipped and fed into the fixing nip N3, so that the toner image is fixed on the recording material S. In this embodiment, the fixing device 130 is provided with a refreshing roller 3 rotatable as a rubbing member for recovering (improving) the surface property thereof by rubbing the surface of the fixing roller 1.

As will be described hereinafter, the refreshing roller 3 superimposes rubbing scratches on both the surface of the fixing roller 1 roughened by the passage of the recording material S, and the surface which is not damaged thereby. By doing so, it reduces the glossiness difference on the image to the extent that the difference is not observed. The refreshing roller 3 gives the rubbing scratches, or embossing the fixing roller 1 substantially without scraping off the surface of the fixing roller 1. In other words, the refreshing roller 3 uniformizes the surface state by roughening the surface of the fixing roller 1 to a desired level. By doing so, the glossiness difference on the image which is not desirable is suppressed.

(1) Fixing Roller

The fixing roller 1 as the rotatable heating member comprises a metal core shaft (base layer) 11, and an elastic layer 12 thereon which comprises a rubber layer and a parting layer 13 thereon as the surface layer. In this embodiment, the core shaft is a hollow core metal of aluminum with an outer diameter of 68 mm. The elastic layer is a silicone rubber layer of 20 degrees (JIS-A, 1 kg load) in a rubber hardness, and it is molded into a thickness of 1.0 mm. The surface parting layer is a coating layer of the 30-micrometer-thick of a fluorinated resin material. The outer diameter of the fixing roller 1 is 70 mm. The parting layer is intended to suppress toner off-set to the fixing roller during the fixing operation. The fixing roller 1 is rotatably supported by a supporting members provided at the opposite ends of the core metal 11 with respect to the longitudinal direction (rotation axis direction). It is rotated in the direction of arrow in the Figure by an unshown motor as driving means.

The parting layer 13 is a fluorinated resin material tube into which the fluorinated resin material having an excellent parting property is formed. As for the fluorinated resin material, PFA resin material (copolymer resin material of a tetrafluorinated ethylene resin materials and perfluoroalkoxyethylene resin material), PTFE (tetrafluorinated ethylene resin materials), and so on are usable. In this embodiment, the material of the parting layer 13 is a PFA resin material tube. The thickness of the parting layer 13 as the surface layer of the fixing roller 1 is preferably 10 micrometers or more and 60 micrometers or less. The Shore hardness of the surface layer of the fixing roller 1 is preferably not less than D40 and not more than D90. The surface layer of the fixing roller 1 is desired to keep the parting property. If it is too soft, the surface layer there of will be scraped with the result of short lifetime. If it is too hard, on the contrary, the rubbing effect by the refreshing roller which will be described hereinafter would not be enough. The Shore hardness in the embodiment is D50.

The fixing roller 1 includes a halogen heater 15 as a heating source therein. The temperature control is effected to provide 160 degrees by an unshown a temperature sensor and an unshown temperature control circuit.

(2) Pressing Roller

A pressing roller 2 as a nip forming member comprises a metal core shaft (base layer) 21, and an elastic layer 22 thereon which comprises a rubber layer and a parting layer 23 as a surface layer thereon. In this embodiment, the core shaft is a hollow core metal of aluminum with an outer diameter of 48 mm. The elastic layer is a silicone rubber of 20 degrees (JIS-A, 1 kg load) in rubber hardness, and the thickness thereof is 1.0 mm. The parting layer is a coating layer of 30-micrometer-thick fluorinated resin material. The outer diameter of the pressing roller is 50 mm. The pressing roller 2 is rotatably supported by the supporting member provided at the opposite ends of a core metal 21 with respect to the longitudinal direction (rotation axis direction). The supporting members at the opposite longitudinal end portions for the pressing roller 2 are urged by the pressing springs (unshown) as the urging means, respectively, so that the pressing roller 2 is pressed to the fixing roller 1 with the predetermined pressure. By doing so, a fixing nip N3 which has a predetermined width (the dimension measured in a peripheral movement direction of the roller) between the fixing roller 1 and the pressing roller 2 is formed. In this embodiment, the pressing roller 2 is pressed by a total pressure 800N against the fixing roller 1.

In this embodiment, the surface movement speed (peripheral speed) of the fixing roller 1 is 220 mm/sec. The peripheral speed of this fixing roller 1 corresponds to the process speed (image outputting speed) of the image forming apparatus 100.

(3) Refreshing Roller

Figure 3:
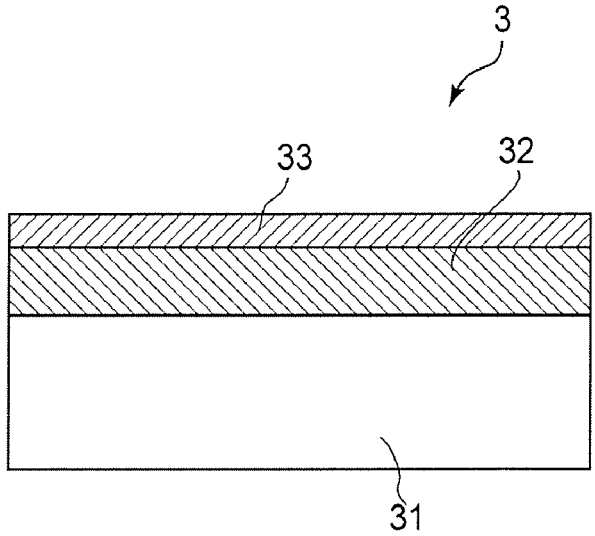
FIG. 3 is a schematic illustration of a structure of the layer of a refreshing roller.

Referring also to FIG. 3, the refreshing roller 3 as the rubbing member comprises a core metal (base material) 31 of SUS304 (stainless steel) with an outer diameter of 12 mm, a rubbing layer (surface layer) 33 as a rubbing material constituted by abrasive grain provided at a high density, and a binding layer (middle layer) 32 between them.

Figure 4:
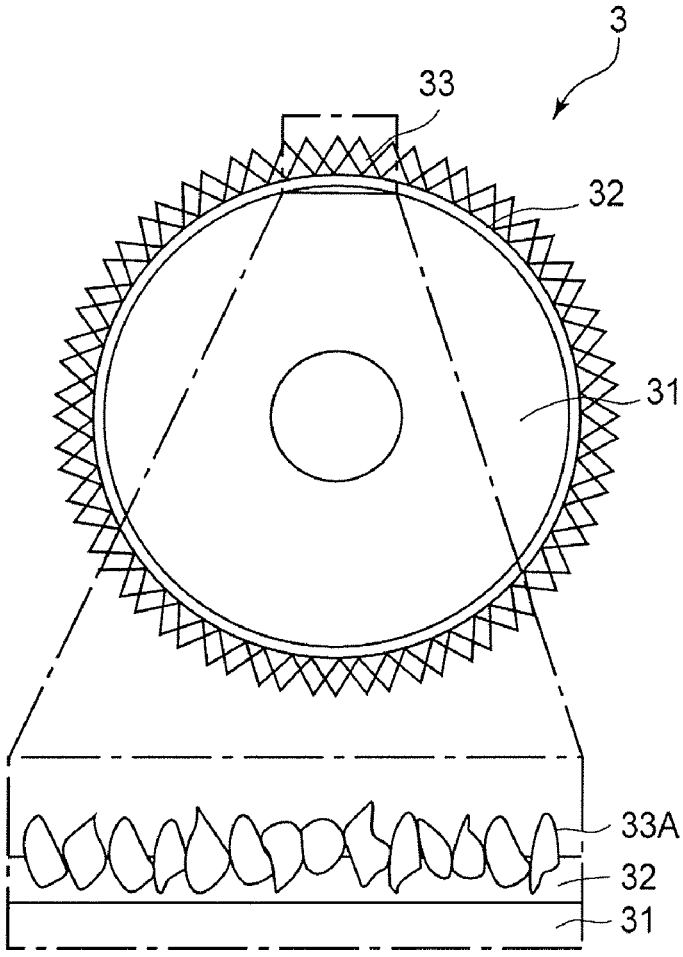
FIG. 4 is a schematic enlarged cross-sectional view of the refreshing roller.

FIG. 4 is a schematic enlarged cross-sectional view of the refreshing roller 3. As for the rubbing material 33A which constitutes the rubbing layer 33 of the surface layer of the refreshing roller 3, usable material includes aluminum oxide, aluminum hydroxide, silicon oxide, cerium oxide, titanium oxide, zirconia, lithium silicate, silicon nitride, silicon carbide, iron oxide, chromium oxide, antimony oxide, diamond, and a mixture of these materials, in the form of abrasive grain bonded by a binding layer 32.

In this embodiment, the rubbing material 33A is alumina (aluminum oxide) (it is also called "Alundum" or "Molundum.") material. An alumina material is abrasive grain used most widely. The material has a sufficiently high hardness as compared with the fixing roller 1, and has an acute angle configuration, and therefore, it is excellent in a machining property and, for this reason, it preferable as the rubbing material 33A in this embodiment.

The refreshing roller 3 is rotatably supported by the supporting members provided at the opposite ends with respect to the longitudinal direction (rotation axial direction) of a core metal 31. The refreshing roller 3 is rotatable by a motor 34 as the driving means. The supporting members of the opposite longitudinal end portion of the refreshing roller 3 are urged by the pressing spring (unshown) as the urging means, by which the refreshing roller 3 is pressed to the fixing roller 1 with a predetermined pressure. By doing so, a rubbing nip N4 which has a predetermined width with respect to each direction of the surface movements between the refreshing roller 3 and the fixing roller 1 is formed. The refreshing roller 3 may be rotated codirectinally or counterdirectionally with respect to the direction of the surface movement of the rollers in the contact portion (rubbing portion) between the refreshing roller 3 and the fixing roller 1. As will be described hereinafter, a peripheral speed difference is preferably provided between the fixing roller 1 and the refreshing roller 3.

The structure and operation of the refreshing roller 3 such as a pressure, a rotational direction, a surface movement speed (peripheral speed), will be described hereinafter.

Thus, the refreshing roller 3 has a laminated structure including at least 3 layers including a base material, a middle layer and a surface layer. The surface layer comprises abrasive grain 33A the rubbing material, and the middle layer has an elastic layer 32 comprising an elastic member. In this embodiment, the bonding layer (adhesive material layer) 32 functions as the elastic layer.

Which will be described hereinafter in detail the microhardness of the refreshing roller 3 is not less than 0.03 GPa and not more than 1.0 GPa. By this, the refreshing roller 3 can rub the fixing roller surface uniformly by the surface layer rubbing material layer 33, and the following advantage. Because of the provision of the elastic layer 32 as the middle layer, even if foreign matter is introduced into between the refreshing roller 3 and the fixing roller 1, the elastic layer 32 can wrap the foreign matter. By this, an accidental production of sharp damages on the fixing roller 1 by the foreign matter and the like externally supplied, can be suppressed. Thus, the occurrence of image defect provided by the transfer of the damage can be avoided. The elastic layer 32 is effective to expand the contact nip N4 between the refreshing roller 3 and the fixing roller 1, so that satisfactory rubbing property can be maintained. In this embodiment, the microhardness of the surface layer of the refreshing roller 3 was 0.07 GPa.

The material of the elastic layer 32 (elastic material rubber, elastomer) may be one or more of butyl rubber, fluorine-containing rubber, acrylic rubber, EPDM, NBR, acrylonitrile-butadiene-styrene rubber, natural rubber, isoprene rubber, styrene-butadiene rubber, butadiene rubber the ethylene-propylene rubber, ethylene-propyleneterpolymer, chloroprene rubber, chlorosulfonated polyethylene, chlorinated polyethylene, urethane rubber, syndiotactic 1,2-polybutadiene, epichlorohydrin rubber, silicone, fluorine-containing rubber, polysulfide rubber, polynorbornene rubber, hydrogenated nitrile rubber, thermoplastic elastomer (polystyrene, polyolefin, polyvinyl chloride, polyurethane, polyamide, polyurea, polyester, fluorinated resin material or the like elastic material). However, the material is not limited to such material.

As will be described hereinafter in detail, the elastic layer 32 is made of an elastic member having a thickness not less than 20 μm and not more than 60 μm and JIS-A hardness (1 kg load) of not less than 40° and not more than 70°. In this example, the used adhesive material has a JIS-A hardness (1 kg load) of not less than 40° and not more than 70°.

By this, the foreign matter between the fixing roller 1 and the refreshing roller 3 can be wrapped, so that damage on the surface of the fixing roller 1 can be prevented. In this embodiment, silicone rubber having a JIS-A hardness of 40° was used as the elastic layer (adhesive material layer) 32. In this embodiment, the thickness of the elastic layer 32 was 40 μm.

Figure 5:
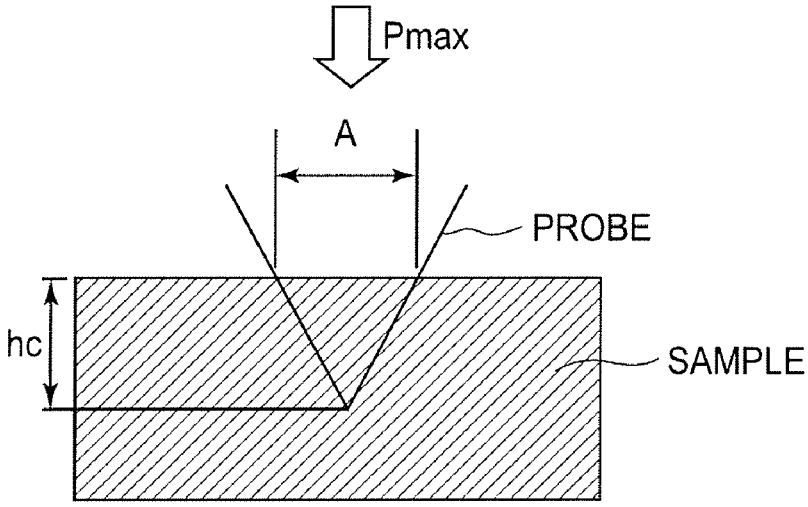
FIG. 5 is an illustration of micro hardness measurement.
Figure 6:
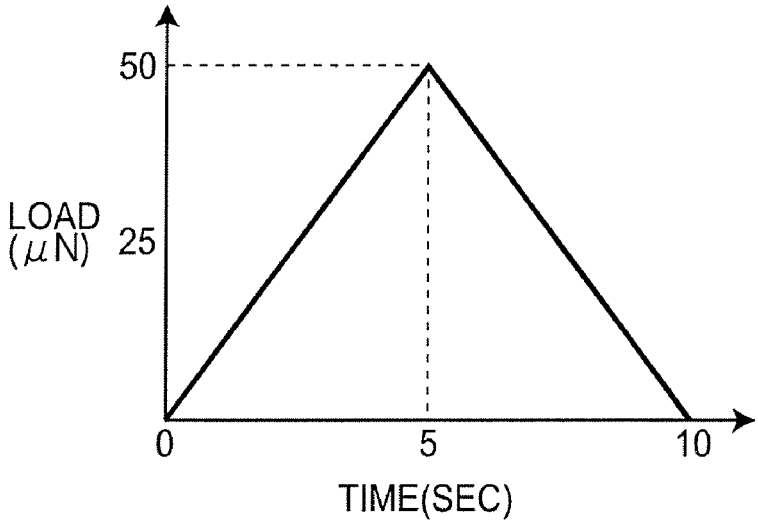
FIG. 6 shows a graph which illustrates the micro hardness intensity measurement.

For the measurement of the microhardness of the surface layer of the refreshing roller 3, triboScope available from HYSITRON as shown in FIG. 5 is used. The measuring probe for measuring the microhardness is the Berkovich chip (142.3 degrees). Here, the load of a measurement using was 50 micro N. The pressure is increased to the load specified for 5 seconds, and the pressure is removed for 5 seconds. FIG. 6 shows a load curve at the time of the load of 50 micro N. The measurement was carried out under the temperature of 23° C. and the relative humidity of 50%. At this time, the hardness H is determined as follows.

$$H=P\max/A.$$

Here, Pmax is a maximum stress applied to a probe, and A is a contact area of the probe. In the case of the used probe, a contact area A is as follows.

$$A=24.5hc^2.$$

where hc is an amount of entering into the inside of the refreshing roller of the probe.

The hardness H of the refreshing roller of this embodiment was 0.07 GPa (50 micro N load).

(4) State of Surface of Fixing Roller

Here, the change of the state of the surface of the fixing roller due to the passage of recording material S will be described.

The inventors have investigated the problem that the surface of the fixing roller 1 is gradually damaged with the contamination by attack of the sheet processing, the paper dust, the offset toner, and so on, particularly, the problem of attack by the sheet passing, and have revealed the following.

Figure 9:
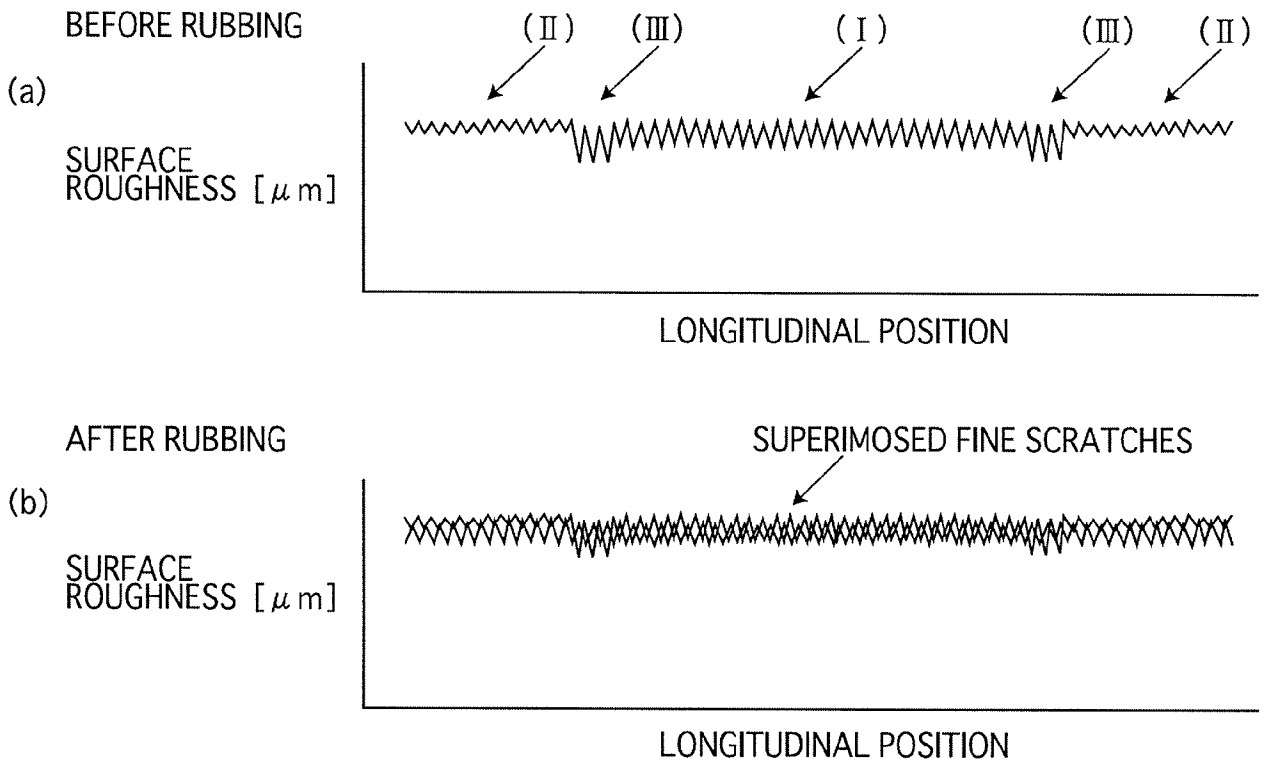
FIG. 9 is the illustration of the state of the surface of the fixing roller.

When many recording sheets are supplied to the fixing roller 1 at the constant position, roughness of the surface of the fixing roller 1 becomes uneven. As shown in FIG. 9(*a*), in the detail, roughness and others of the surface of the fixing roller 1 differs from each other among (I) a sheet passing area, the (II) non-sheet-passing area, and (III) region corresponding to an edge portion of the boundary between the sheet passing area and the non-sheet-passing area.

Figure 10:
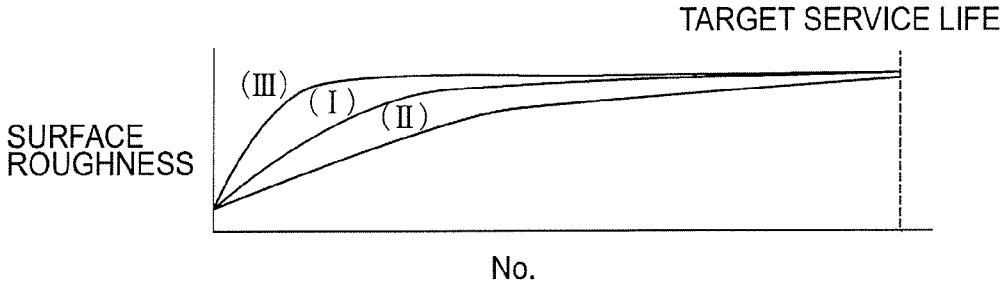
FIG. 10 shows a graph which illustrates the change of the state of the surface of the fixing roller.

The surface of the fixing roller 1 provided with the surface parting layers, such as the fluorinated resin material, is in the state of the specular surface, and in the initial stage of usage, the surface roughness Rz (JIS, ten-point average roughness) thereof is about 0.1 micrometer-0.3 micrometer. In the region which the recording paper passes (i) on the fixing roller 1, the surface of the fixing roller 1 is gradually leveled by attack, such as the fiber of paper, and an externally added material of the toner. The surface roughness Rz of the fixing roller 1 of this region is gradually increased to approx 1.0 micrometer (FIG. 10).

For the measurement of the surface roughness Rz, ( ) a surface roughness measuring device SE-3400 available from Kabushiki Kaisha Kosaka Kenkyujo was used. As for the measuring condition, a sending speed is 0.5 mm/s, a cutting off is 0.8 mm, and a measurement length is 2.5 mm.

Figure 11:
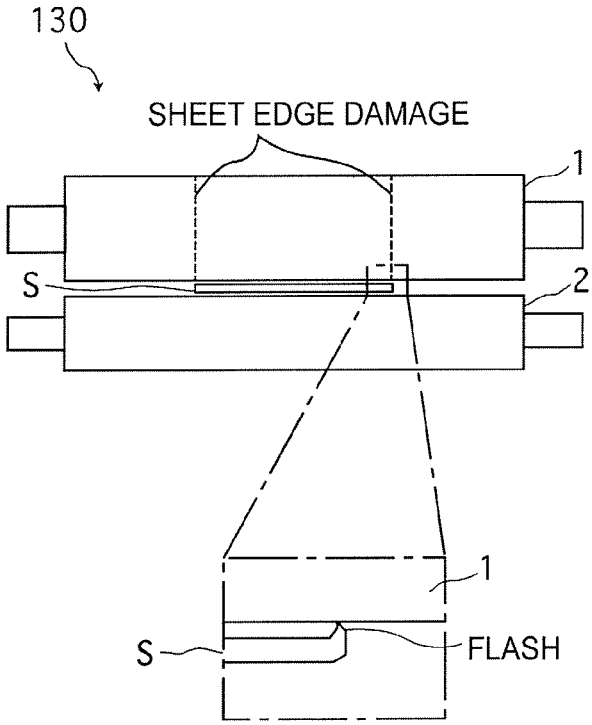
FIG. 11 is a schematic illustration of the flash.

The edge (hereafter called "edge portion") around the recording sheet has the flash produced during a period in which paper is cut (FIG. 11). For this reason, in the region (III) corresponding to the edge portion, against the fixing roller 1, attack is comparatively large and the surface roughness Rz of the fixing roller 1 of this region is gradually increased to about 1.0 micrometers-2.0 micrometers (FIG. 10). When a cutting blade wears in a cutting step from the large size and sharpness becomes the poor, it is easy to produce the flash.

In the region (III) through which the recording paper does not pass, the surface of the fixing roller 1 is contacted to an opposing pressing roller 2. The surface roughness Rz of the fixing roller 1 of this region is slowly increased as compared with the sheet passing area (i) to approx 1.0 micrometer.

As a result, the surface roughness of the fixing roller after the continuous sheet processing changes as follows.

edge portion(III)>sheet-passing region(I)>non-sheet-passing region(III)>Initial state.

For this reason, the states of the surface of the fixing roller 1 differ depending on a longitudinal position.

The state of the surface of the fixing roller 1 and a gloss non-uniformity on the image will be described.

Figure 12:
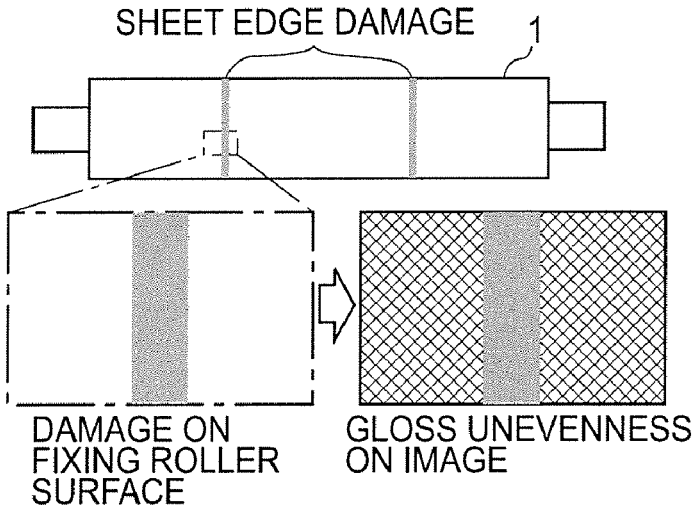
FIG. 12 is the illustration of damage by the flash.

When the toner image of the unfixed is fixed on recording material S, the fixing device 130 supplies the pressure and the heat to recording material S. At this time, the state of the minute surface of the fixing roller 1 is impressed on the surface of the toner image after the fixing. When the state of the surface on the fixing roller 1 changes, the difference of the surface state appears on the toner image correspondingly to it. As a result, a glossiness non-uniformity (non-uniformity unevenness in glossiness) is produced on the image (FIG. 12).

Particularly this phenomenon is remarkable in the high gloss coated paper having a high surface smoothness. In the case of the high quality paper used in an offices, it is usually on an invisible level. As a result of the investigation of the inventors, production of the scratches by the edge portion of a sheet is dependent on the paper kind, but in the case of the paper which has a large flash produced by the paper cutting, the scratches are relatively large. The scratches due to the edge portion in other thick paper, a coated paper, and so on are relatively less.

Generally in the case having a high the reproducibility of the positive reflected light image, the glossiness is high. It is low when the reproducibility is low or nothing. For example, when the image of a film photograph is seen under the illumination of a fluorescent lamp, not only the light of the fluorescent lamp but the configuration of the fluorescent lamp thereof is reflected. In this case, the high glossiness is recognized irrespective of consciousness. This is because the state of the surface of a photographic image is smooth and specular. On the other hand, in the case of the low glossiness, the contrary applies. The state of the surface of the image is unsmooth, the light of the fluorescent lamp is diffused, and, the configuration thereof is not reflected on the image. In this manner, there is an interrelation between the unsmoothness and the glossiness of the state of the surface on the image.

For this reason, particularly, in the case of fixing an image on the high-glossiness coated paper which requires a high image quality, the strips of the low glossiness appears in the position (roughened position) corresponding to the edge portion of the fixing roller 1, or the glossiness difference is produced between the sheet passing area and the non-sheet-passing area. In this manner, the gloss non-uniformity is produced on the image.

(5) Rubbing Operation by Refreshing Roller (Refreshing Operation):

In this embodiment, the gloss non-uniformity on the image due to the surface of the fixing roller 1 damaged by the passage of recording material S is eliminated using the refreshing roller 3. More particularly, the difference of the unsmoothness of the surface state is removed by imparting fine rubbing scratches throughout the longitudinal direction (the sheet passing area, the non-sheet-passing area) on the fixing roller 1 by the refreshing roller 3. In this manner, the state of the surface of the fixing roller 1 can be changed by the refreshing roller 3 (renewal). By doing so, the low glossiness stripe and the glossiness difference between the sheet passing area and the non-sheet-passing area in the position corresponding to the edge portion are eliminated on the image. In other words, the state of the surface of the fixing roller can be improved. The scratches provided on the fixing roller 1 by the refreshing roller 3 imparting such many fine rubbing scratches are invisible on the image. In other words, in this embodiment, the fine rubbing scratches are superimposed on the existing scratches which the surface of the fixing roller 1 has, and, by doing so, they are made invisible on recording material S (FIG. 9(*b*)).

More particularly, in this embodiment, the fixing roller 1 is rubbed using the refreshing roller under the following conditions. the particle size of the grains 33A of the surface layer 33 of the refreshing roller 3 is 9 μm, and the thickness of the elastic layer 32 of the refreshing roller is 40 μm. the refreshing roller 3 is rotated at the speed of 70% speed difference counterdirectionally relative to the fixing roller 1. the contact pressure of the refreshing roller to the fixing roller is 100 g/cm.

Here, the particle size of abrasive grain is determined using the scanning electron microscope S-4500 (available from Kabushiki Kaisha Hitachi Seisakusho, Japan). Randomly, 100 or more abrasive grains are extracted, and, a number average particle size is calculated using imaging process analyzing apparatus Luzex3 (available from Kosaka Kabushiki Kaisha, Japan).

The rotation of the refresh roller 3 with the peripheral speed difference (peripheral speed ratio rate) of 70% counterdirectionally relative to the fixing roller 1 means the following.

For example, when the peripheral speed of the fixing roller 1 is 220 mm/sec, the refresh roller 3 is rotated at 66 mm/sec so that surface of the refresh roller 3 moves counterdirectionally (opposite direction) at the contact portion (sliding portion) relative to the fixing roller 1.

When the peripheral speed of the fixing roller is V mm/sec, and the peripheral speed of the refresh roller is v mm/sec.

Taking the peripheral speed V of the fixing roller as a positive, the peripheral speed of the refresh roller is positive when the surface moving direction is the same as that of the fixing roller at the contact portion (sliding portion) between the fixing roller and the refresh roller, and is negative if it is the opposite.

$(|V-v|/V)\times 100$ at this time is called peripheral speed ratio, here.

The contact pressure [g/cm] of the refresh roller 3 is measured by measuring the contact pressure by a surface pressure measurement distribution system I-SCAN (available from Nitta Kabushiki Kaisha), and by dividing the measured pressure by the contact width (in the rotation axial direction).

The measurement is carried out with the fixing roller and the refresh roller kept at rest.

After 1000 sheets of A4R width are processed (the scratches or damage is given), the rubbing operation of the refresh roller 3 is carried out to the fixing roller 1 for 30 sec.

By the contact for 30 sec, the surface of the fixing roller 1 is changed from the state schematically shown in FIG. 9, (a) to the state shown in FIG. 9, (b) By the contact of the refresh roller 3, the entire area surface of the fixing roller 1 is given a large number of rubbing scratches.

The fixing roller 1 having a parting layer of fluorinated resin material or the like as the surface layer, for example, has a surface roughness of Rz 0.1 μm-0.3 μm in an unroughened state, but the surface roughness of Rz of the roughened surface (non-directional recesses) is 0.5 μm-2.0 μm.

In addition, the rubbing grooves (recesses) which have 10 micrometers or less in width (measured in the rotation axis direction) by the rubbing material 33A are formed in the rotation axial direction at the ratio of 10 or more per 100 micrometers. By doing so, the surface of the fixing roller 1 is refreshed or improved, so that the glossiness unevenness is suppressed. Although the surface of the fixing roller is rubbed by the refreshing roller 3, the amount of wearing is very small, more particularly, it is 3 micrometers for the rotation period, which corresponds to 300,000 sheet processings. In this manner, the surface of the fixing roller 1 having the damage provided by the flash of the sheets is subjected to the rubbing with the refreshing roller 3, by which very fine scratches are superimposed on the fixing roller surface. By doing so, the glossiness difference is made non-remarkable, thus providing uniform glossiness distribution.

The rubbing operation by the refreshing roller 3 imparts the fine rubbing scratch positively and intentionally to the surface of the fixing roller 1. It does not mean or intend to expose an underlying portion of the surface by scraping the surface of the fixing roller 1. Namely, a rubbing level of the fixing roller 1 by the refreshing roller 3 is not the level as in the conventional abrasion of the fixing roller 1, but is the level for restoring the state of the unsmoothness of the surface of the fixing roller 1 to the initial state (embossing or impressing level). In other words, the recessed state of the surface of the fixing roller 3 is recovered (improved) by the rubbing of the fixing roller 1 using the refreshing roller 3. For this reason, the scraped amount of the parting layer 13 of the fixing roller 1 by the refreshing roller 3 is within the levels which cannot be measured, over the lifetime of the fixing roller 1 or within the measurement error level. However, since the fixing roller is damaged by the refreshing roller 3, this scraped amount does not mean that the surface of the fixing roller is not scraped at all.

(6) Execution of Rubbing Operation

As for the refreshing roller 3, it is not inevitable to always continue rubbing the fixing roller 1 during the image formation. In this embodiment, there is provided to a counter for counting the number of image formations (the number of the sheet passing operations). rubbing operation is automatically carried out periodically on the basis of the output of the counter. Alternatively, the rubbing operation is carried out when a user is concerned with the gloss non-uniformity on the image. In order to accomplish this, an operation button may be provided in an operating portion of the image forming apparatus 100 as a user selectable mode. In the fixing device 130 according to this embodiment, the separating/contacting means which makes the refreshing roller 3 movable toward and away from the fixing roller 1 is provided.

In this embodiment, the refreshing roller 3 provided with the separating/contacting mechanism and a rotating mechanism is contacted to the fixing roller 1 by the proper timing. The separating/contacting operation, relative to the fixing roller 1, of the refreshing roller 3 by the separating/contacting mechanism 36 is controlled through a motor 35 and a controller 37 as control means. In addition, in this embodiment, the controller 37 controls the operation of the motor 34 which transmits a driving force to the refreshing roller 3. The pressing, to the fixing roller 1, of the refreshing roller 3 is carried out, as has been described hereinbefore, by pressing the opposite ends of the refreshing roller 3 by means of springs.

In this manner, in this embodiment, by the separating/contacting mechanism, the refreshing roller is movable toward and away from the fixing roller 1, and usually, the state of the contact is established at the desired timing and for a desired period of time, from the state of the spacing in an image formation, by which the surface of the fixing roller can be modified.

In a specific example, the refreshing roller 3 can be contacted to the fixing roller 1 under the following condition. Namely, in the image forming apparatus 100, for example, when recording material supplying having a size smaller than A3, the cumulative sheet processing number thereof is counted. When the cumulative number of exceeds a predetermined value (usually, 100-1000, in this embodiment, 500 sheets), the image forming apparatus 100 carries out a rubbing mode for the fixing roller 1. In the rubbing mode, the separating/contacting mechanism 36 of the refreshing roller 3 operates in the state of temporary rest of an image forming operation, and, the operation for contacting the refreshing roller 3 to the fixing roller 1 is carried out. For example, when a mechanism for spacing the pressing roller 2 from the fixing roller 1 is provided, the pressing roller 2 is spaced from the fixing roller 1 simultaneously with the contact, to the fixing roller 1, of the refreshing roller 3. When the separating operation of the pressing roller 2 finishes, the fixing roller 1 starts a rotating operation at a predetermined peripheral speed (usually the same as the peripheral speed at the time of the image formation). With the predetermined peripheral speed difference, the refreshing roller 3 starts the rotating operation and, operates for a preset time period (15-300 seconds; 30 seconds in this embodiment). Thereafter, when the operations of the fixing roller 1 and the refreshing roller 3 finish, it returns to the state of the normal image formation.

In this manner, the separating/contacting mechanism of the refreshing roller 3 can be provided. The scratches on the fixing roller 1 produced by the edge of paper will appear on the image, typically when the image is formed thereafter on the paper having a size larger than paper. In view of this, the operation for contacting the refreshing roller 3 to the fixing roller 1 may be carried out only at the time of such a paper kind change. By doing so, the lifetimes of the fixing roller 1 and the refreshing roller 3 can preferably be expanded.

In another example, the refreshing roller 3 can be contacted to the fixing roller 1 under the following condition. Namely, the timing at which the refreshing roller 3 is pressed relative to the fixing roller 1 may be when the unevenness of the flaw or the roughness is produced on the surface of the fixing roller 1 by the edge of the recording sheet and the foreign matter, and an image defects, such as the flaw and the glossiness non-uniformity, appear on the image. In this case, when the user selects the rubbing operation for the fixing roller 1 (uniformization process) on the operating portion of the image forming apparatus 100, the refreshing roller 3 is pressed to the fixing roller 1 and rotated for a desired time duration.

In this embodiment, the refreshing roller 3 is driven by the driving means exclusively therefor, but the present invention is not limited to this. For example, the driving force is transmitted from the driving means for the fixing roller 1 so that it is rotated with a peripheral speed difference relative to the fixing roller 1 by a driving gear. For example, the gears of the fixing roller 1 and the refreshing roller 3 are coupled with a gear ratio of 1 to 2, by which the refreshing roller 3 can be driven with the surface speed twice the surface speed of the fixing roller 1.

(7) Test Examples

The durability tests have been carried out wherein small size sheets are continuously fed.

A4 size sheets having a basis weight of 80 g/m2 are longitudinally fed (fed in the longitudinal direction).

After 500 sheets are continuously processed, the sliding mode operation for the fixing roller 1 is automatically carried out.

After 30 sec of the sliding operation, A3 size sheets are processed, and the images are evaluated.

The evaluation includes the gloss non-uniformity of the image attributable to the flash and the gloss non-uniformity attributable to foreign matter.

The durability test is carried out for 10,000 sheets.

The microhardness [GPa] of the surface layer of the refreshing roller 3 was changed to 0.01, 0.03, 0.5, 1.0, 2.0, 3.0.

The thickness of the sliding material layer (abrasive grain layer) 33 and the material per se of the sliding material (abrasive grain) 33A are not changed, and the adhesive material, that is, the hardness of the adhesive material layer 32 as the elastic layer is changed.

The other conditions are as described above.

The elastic layer 32 of the refreshing roller 3 had a thickness of 40 μm.

The particle size of the abrasive grain 33A was 9 μm.

The refreshing roller 3 is rotated at the 70% peripheral speed difference for counter-directional surface movement relative to the fixing roller 1.

The contact pressure of the refreshing roller 3 to the fixing roller 1 was 100 g/cm.

Table 1 shows the microhardness of the refreshing roller 3, the hardness (JIS-A) of the adhesive material and the results of the durability tests.

TABLE 1

| Microhardness (GPa) | Binder Hardness (°) | No. of processed sheets ○ | 2000 | 4000 | 6000 | 8000 | 10000 | Remarks |
|---|---|---|---|---|---|---|---|---|
| 0.01 | 20 | ○ | ○ | x | x | x | x | insufficient rubbing force |
| 0.03 | 40 | ○ | ○ | ○ | ○ | ○ | ○ | |
| 0.50 | 50 | ○ | ○ | ○ | ○ | ○ | ○ | |
| 1.00 | 70 | ○ | ○ | ○ | ○ | ○ | ○ | |
| 2.00 | 80 | ○ | ○ | ○ | ○ | x | x | |
| 3.00 | 90 | ○ | ○ | ○ | x | x | x | Damage due to foreign matte introduction |

○: No problematic stripes
x: Problematic stripes

When the microhardness is 0.01 GPa, image stripes (particularly gloss non-uniformity) appear on the image due to insufficiency of the rubbing force of the refreshing roller 3.

It is considered that adhesive material layer 32 of the refreshing roller 3 is so soft that the abrasive grain 33A of the surface layer 33 is completely immersed into the adhesive material layer 32 in the nip (sliding nip) N4 formed by the refreshing roller 3 and the fixing roller 1 contacted to each other.

When the microhardness is not less than 0.03 GPa, the abrasive grain 33A does not immerse in the adhesive material layer 32 in the nip N4, so that satisfactory rubbing power is provided.

On the other hand, when the microhardness is 2.0 GPa, 3.0 GPa, the damage appears on the fixing roller 1. The damage is considered as being produced by the foreign matter (paper dust, developer carrier particles and so on) introduced into the nip N4 between the refreshing roller and the fixing roller 1 during the durability test.

Because of this, image stripes appear on the image.

From these results, it is understood that microhardness the GPa] of the surface layer of the refreshing roller 3 is desirably not less than 0.03 and not more than 1.0.

The abrasive grain 33A having five levels of particle sizes in the range of 3 μm-30 μm is prepared, and the durability tests (10,000 sheets) were carried out for the respective grain sizes.

The other conditions are as described above.

The elastic layer 32 of the refreshing roller 3 had a thickness of 40 μm.

The refreshing roller 3 is rotated at the 70% peripheral speed difference for counter-directional surface movement relative to the fixing roller 1.

The contact pressure of the refreshing roller 3 to the fixing roller 1 was 100 g/cm.

Table 2 shows the results of the durability tests.

TABLE 2

| Particle size (μm) | No. of processed sheets ○ | 2000 | 4000 | 6000 | 8000 | 10000 | Remarks |
|---|---|---|---|---|---|---|---|
| 3 | ○ | ○ | x | x | x | x | insufficient rubbing force |
| 5 | ○ | ○ | ○ | ○ | ○ | ○ | Good |
| 10 | ○ | ○ | ○ | ○ | ○ | ○ | Good |
| 20 | ○ | ○ | ○ | ○ | ○ | ○ | Good |
| 30 | ○ | x | x | x | x | x | Damage by grain |

When the particle size of the abrasive grain 33A is 3 μm, the rubbing force relative to the fixing roller 1 is so insufficient that image stripes (particularly gloss non-uniformity) appear on the image.

When the particle size of the abrasive grain 33A is 5 μm, 10 μm or 20 μm, the level of the image stripes is not a problem throughout the 10,000 sheets durability tests.

But, when the particle sizes of the abrasive grain 33A is 30 μm, such scratches due to the grain as are influential to the image are formed on the surface of the fixing roller 1.

This results on the entire image as image defects.

From the results, the size of the abrasive grain 33A (particle sizes) is preferably not less than 5 μm and not more than 20 μm.

As described above, it is preferable that abrasive grain 33A is densely provided in the surface layer of the refreshing roller 3.

It is preferable that surface layer 33 of the refreshing roller 3 comprises particles having a particle sizes of not less than 5 μm and not more than 20 μm and has a thickness of not less than 5 μm and not more than 20 μm.

If the particle size is less than the lower limit of the range, the rubbing effect of the refreshing roller 3 is not enough.

If it exceeds the upper limit of the range, the surface of the fixing roller 1 is so damaged that image is influenced.

Then, the thickness of the elastic layer 32 of the refreshing roller 3 is changed in five levels (10, 20, 40, 60 and 80 μm), and the similar durability tests were carried out.

The particle size of the abrasive grain 33A is 10 μm, and the other conditions have been as described hereinbefore.

Table 3 shows the results of the durability tests.

TABLE 3

| Thickness of Elastic layer | No. of processed sheets | | | | | | |
|---|---|---|---|---|---|---|---|
| (μm) | ○ | 2000 | 4000 | 6000 | 8000 | 10000 | Remarks |
| 10 | ○ | ○ | ○ | x | x | x | Damage due foreign matter |
| 20 | ○ | ○ | ○ | ○ | ○ | ○ | Good |
| 40 | ○ | ○ | ○ | ○ | ○ | ○ | Good |
| 60 | ○ | ○ | ○ | ○ | ○ | ○ | Good |
| 80 | ○ | ○ | ○ | ○ | x | x | Increased torque |

○: No problematic stripes
x: Problematic stripes

When the elastic layer 32 is 10 μm, the image damage attributable to the introduction of foreign matter from the initial stage of the durability tests.

When the elastic layer 32 has the thickness 20 μm, 40 μm or 60 μm, satisfactory durability has been confirmed.

But, when the thickness of the elastic layer 32 is 80 μm, operation defects attributable to the torque rise of the driving motor for the refreshing roller 3 occurred.

It is considered that thickness elastic layer 32 expands the nip N4 with the result that frictional force is large.

In order to eliminate this, it is considered that motor capacity is raised, but doing so is not preferable in view of the bulkiness of the apparatus.

From these results, the thickness of the elastic layer 32 is preferably within the range of not less than 20 μm and not more than 60 μm.

Then, the rotational direction of the refreshing roller 3 and the peripheral speed difference (peripheral speed ratio) relative to the fixing roller 1 are changed, and similar durability tests were carried out.

The peripheral speed difference of the refreshing roller 3 relative to the fixing roller 1 was 25%, 50%, 100% or 150% when the rotational direction of the refreshing roller 3 is opposite to the direction of the fixing roller 1 (opposite at the contact portion).

On the other hand, when the directions are the same, it was 200%, 250%, 300% or 350%.

The other conditions are as described above.

The elastic layer 32 of the refreshing roller 3 had a thickness of 40 μm.

The particle size of the abrasive grain 33A was 9 μm.

The contact pressure of the refreshing roller 3 to the fixing roller 1 was 100 g/cm.

Table 4 shows the results of the durability tests.

TABLE 4

| Rot. | Diff. | No. of processed sheets | | | | | | |
|---|---|---|---|---|---|---|---|---|
| directin | (%) | ○ | 2000 | 4000 | 6000 | 8000 | 10000 | Remarks |
| Opposite | 150 | ○ | ○ | ○ | x | x | x | Torque increase |
| | 100 | ○ | ○ | ○ | ○ | ○ | ○ | Good |
| | 50 | ○ | ○ | ○ | ○ | ○ | ○ | Good |
| | 25 | ○ | ○ | x | x | x | x | insufficient rubbing force |
| Same | 200 | ○ | ○ | x | x | x | x | insufficient rubbing force |
| | 250 | ○ | ○ | ○ | ○ | ○ | ○ | Good |
| | 300 | ○ | ○ | ○ | ○ | ○ | ○ | Good |
| | 350 | ○ | ○ | x | x | x | x | Torque increase |

○: No problematic stripes
x: Problematic stripes

When the peripheral speed difference opposite 25% and when it is same 200%, the rubbing force of the refreshing roller 3 is not sufficient, and image stripes (gloss non-uniformity) appear on the image.

On the other hand, the peripheral speed difference is opposite 150% and when it is same 350%, operation defects due to torque rise of the driving motor for the refreshing roller 3 occurs.

From these results, the peripheral speed difference (peripheral speed ratio) of the refreshing roller 3 relative to the fixing roller 1 is preferably not less than 50% and not more than 100% when the surface moving direction is opposite to the fixing roller 1 at the contact portion (rubbing portion).

The peripheral speed difference (peripheral speed ratio) of the refreshing roller 3 relative to the fixing roller 1 is preferably not less than 250% and not more than 300% when the surface moving direction is the same as the fixing roller 1 at the contact portion (rubbing portion).

With respect to the rubbing force of the refreshing roller 3 relative to the fixing roller 1, the peripheral speed difference between the refreshing roller 3 and the fixing roller 1 is thought to be important, and if the peripheral speed difference is within the preferable range, the rotational direction of the refreshing roller 3 may be either.

Finally, the contact pressure of the refreshing roller 3 relative to the fixing roller 1 is changed, and the similar durability tests were carried out.

The contact pressure [g/cm] are changed to five levels 25, 50, 100, 150, 200.

The other conditions are as described above.

The elastic layer 32 of the refreshing roller 3 had a thickness of 40 μm.

The particle size of the abrasive grain 33A was 9 μm.

The refreshing roller 3 is rotated at the 70% peripheral speed difference for counter-directional surface movement relative to the fixing roller 1.

Table 5 shows the results of the durability tests.

TABLE 5

| Press. | No. of processed sheets | | | | | | |
|---|---|---|---|---|---|---|---|
| (g/cm) | ○ | 2000 | 4000 | 6000 | 8000 | 10000 | Remarks |
| 25 | ○ | ○ | ○ | x | x | x | insufficient rubbing force |
| 50 | ○ | ○ | ○ | ○ | ○ | ○ | Good |
| 100 | ○ | ○ | ○ | ○ | ○ | ○ | Good |
| 150 | ○ | ○ | ○ | ○ | ○ | ○ | Good |
| 200 | ○ | ○ | x | x | x | x | Torque increase |

○: No problematic stripes
x: Problematic stripes

When the contact pressure is 25 g/cm, the rubbing force is not sufficient with the result of image stripe the particularly gloss non-uniformity) appearing on the image.

On the other hand, when the contact pressure is 50 g/cm, 10 g/cm, 150 g/cm, satisfactory durable properties are confirmed.

However, the contact pressure is 200 g/cm, operation defects due to driving torque rise of the refreshing roller 3 occurred.

From the results, the contact pressure of the refreshing roller 3 is preferably not less than 50 g/cm and not more than 150 g/cm.

In other words, the contact pressure of the refreshing roller 3 is preferably within the range of not less than 49 N/m and not more than 147 N/m.

The fixing roller 1 and the refreshing roller 3 can form a wide nip N4 because of the provisions of the elastic layer 12 in the fixing roller 1 and the elastic layer 32 in the refreshing roller 3.

This is effective to reduce the time required for changing the surface roughness of the fixing roller 1.

As for the surface layer 13 of the fixing roller 1, any can be used if it has an excellent parting property and is capable of cooperating with the refreshing roller 3 to form a proper nip N4.

For example, the following is usable examples.

A roller comprises a core metal made of aluminum, a HTV (high temperature vulcanization type) silicone rubber layer having a thickness of 2.8 mm, thereon, and a dimethyl silicone rubber coating layer of RTV (room temperature vulcanization type) thereon having an outer diameter of 40 mm.

Another roller comprises an aluminum core metal having of thickness of 1 mm, and a PFA tube having a thickness of 50 μm coating it with an adhesive material.

As described in the foregoing, by contacting the refreshing roller 3 having the elastic layer 32 to the surface layer of the fixing roller 1 to rub it, by which the damage to the fixing roller 1 attributable to the flash at the lateral ends of the sheet during the continuous sheet processing.

By this, uniform gloss images can be formed stably.

According to this embodiment, even if foreign matter is introduced into between the refreshing roller 3 and the fixing roller 1, the damage influential to the resultant image is not given on the fixing roller 1.

In addition, according to this embodiment, the reduction of the lifetime of the fixing roller 1 is suppressed, and the glossiness non-uniformity on the image due to the trace of passage of the recording materials S can be suppressed.

(Detailed Settings of the Rubbing Rotatable Member)

By giving the fine rubbing scratches to the fixing roller, the preferable setting of the fixing device for eliminating the gloss non-uniformity attributable to the scratches on the fixing rollers produced by the edge portion, will be described in detail. Here, by changing the conditions of the rubbing rotatable member and the rubbing operation, the rubbing scratches of different levels are given on the fixing roller, and eliminating power for the gloss non-uniformity on the image is investigated. In addition, the investigations are made about whether the damaging scratches are produced.

SPECIFIC EXAMPLES AND COMPARISON EXAMPLES

Table 1 shows specific examples and comparison examples of the settings which satisfy the preferable apparatus condition which will be described hereinafter.

Here, in the comparison examples, the use is made with a fixing device of an oil application type. The fixing roller of this fixing device comprises an aluminum hollow core metal with an outer diameter of 68 mm and the silicone rubber thereon which has 20 degrees (JIS-A, 1 kg load) of rubber hardness, as the elastic layer. It has 1.0 mm in thickness, and an outer diameter of 70 mm. The outer periphery of the fixing roller is contacted by an oil application roller. The microhardness of the surface layer of the fixing roller of the fixing device of oil application type was a 0.02 GPa. The pressing roller of the fixing device has aluminum hollow core metal with an outer diameter of 48 mm and the silicone rubber which has 20 degrees (JIS-A, 1 kg load) of rubber hardness, as the elastic layer. It has 1.0 mm in thickness, and an outer diameter of 50 mm. This pressing roller is pressed to the fixing roller with a total pressure of 800N.

The fixing device of an oil-less type has the structure similar to the fixing device of an embodiment except for the various condition settings shown in Table 6.

TABLE 6

| | Fixing roller | Rubbing member | Per. spd mm/sec | Press. [N] | Time |
|---|---|---|---|---|---|
| Comp Ex. 1 | Oil | Cleaning web | ≈0 | 20 | 5 Sec |
| Comp. Ex. 2 | Oil-less | Cleaning web | ≈0 | 20 | 5 Sec |
| Comp. Ex. 3 | Oil-less | Refresh roller #4000 | 0 | 20 | 5 Sec |
| Comp. Ex. 4 | Oil-less | Refresh roller #1000 | 220 Drivn | 20 | 5 Sec |
| Comp. Ex. 5 | Oil-less | Refresh roller #1000 | 220 Driven | 20 | 50 Sec |
| Comp. Ex. 6 | Oil-less | Refresh roller #800 | −110 | 20 | 5 Sec |
| Example 1 | Oil-less | Refresh roller #1000 | −110 | 20 | 5 Sec |
| Example 2 | Oil-less | Refresh roller #4000 | −110 | 20 | 5 Sec |
| Comp. Ex. 7 | Oil-less | Refresh roller #6000 | −110 | 20 | 5 Sec |
| Example 3 | Oil-less | Refresh roller #4000 | −110 | 10 | 5 Sec |
| Example 4 | Oil-less | Refresh roller #4000 | −110 | 100 | 5 Sec |
| Comp. Ex. 8 | Oil-less | Refresh roller #4000 | −110 | 150 | 5 Sec |
| Example 5 | Oil-less | Refresh roller #4000 | 440 | 20 | 5 Sec |
| Comp. Ex. 9 | Oil | Refresh roller #4000 | −110 | 20 | 5 Sec |

Figure 8:
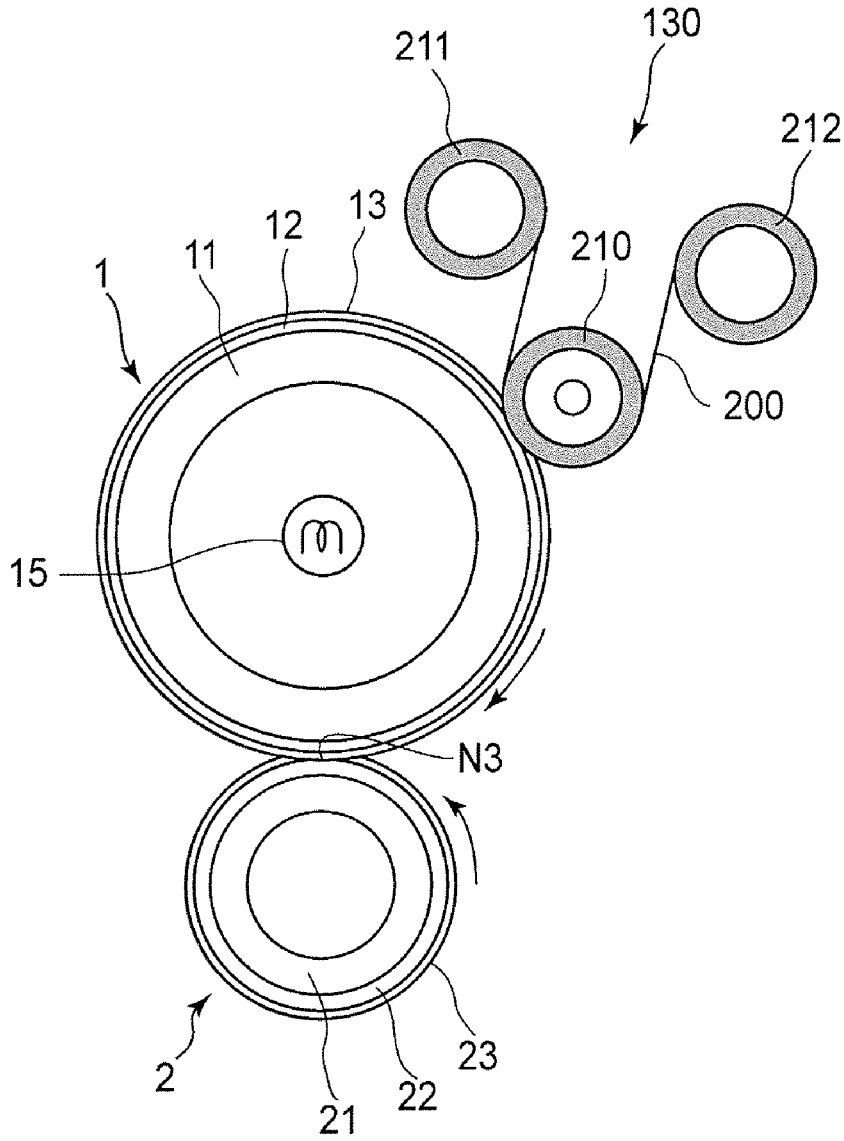
FIG. 8 is the schematic sectional view of an example of the fixing device of a comparison example.

As shown in FIG. 8, the rubbing rotatable members for rubbing the fixing roller 1 in the comparison examples 1 and 2 are not the refreshing rollers 3 but cleaning webs 200. This cleaning web 200 is made of ordinary heat resistive fibers (Nomex (tradename)). As for the cleaning web 200, the web roller 210 provided with the elastic layer is pressed by the springs with total pressure of 20N at the opposite longitudinal end portions, by which it is pressed to the fixing roller 1. The cleaning web 200 is moved from a winding-off side (winding-off roller) 211 to a winding-up side (winding-up roller 2-2) by about 0.5 mm per one sheet of recording material S intermittently. However, it is substantially at rest relative to the peripheral speed 220 mm/sec of the fixing roller 1.

The time (time duration of the rubbing operation) of the rubbing is the time in which the operation scratching the surface of the fixing roller 1 by the rubbing rotatable member is carried out. The outer diameter of the fixing roller 1 is 70 mm, and therefore, an outer periphery length is 220 mm (70π mm), and 5 seconds of the rubbing operation corresponds to 5 full-turns of the fixing roller 1.

In the comparison examples 3-9 and the specific examples 1-5, the refreshing roller 3 is used. As has been described hereinbefore, the refreshing roller 3 has the core metal 31 of SUS with an outer diameter of 12 mm, and the binding layer 32 thereon. In the binding layer 32, abrasive grain 33A is bonded densely (FIG. 4). #800, #1000, #4000, #6000 in Table 6 are the grits of abrasive grain 33A of the refreshing rollers 3. The particle sizes of abrasive grain 33A has a certain range of distribution, but, average particle size #800 corresponds to about 20 micrometers, #1000 corresponds to about 16 micrometers, and #4000 corresponds to about 3 micrometers, and, #6000 corresponds to about 2 micrometers. Abrasive grain 33A is of above described alumina type.

It is preferable that average particle sizes of abrasive grain are 5 micrometers or more and 20 micrometers or less correspondingly to the grit No. of above described abrasive grain.

Here, the particle size of abrasive grain is determined using the scanning electron microscope S-4500 (available from Kabushiki Kaisha Hitachi Seisakusho, Japan). Randomly, 100 or more abrasive grains are extracted, and, a number average particle size is calculated using imaging process analyzing apparatus Luzex3 (available from Kosaka Kabushiki Kaisha, Japan).

The pressure (total pressure) N to the roller is measured by surface pressure measurement distribution system I-SCAN (available form Nitta Kabushiki Kaisha, Japan). The measurement is carried out by the state where the fixing roller and the pressing roller are at rest.

In each example, the refreshing roller 3 is pressed by the springs in the opposite longitudinal end portions thereof with the total pressures of 10N-150N, to the fixing roller 1.

The peripheral speed of 0 mm/sec means that the refreshing roller 3 is at rest in the comparison example 3. The peripheral speed of 220 mm/sec in the comparison examples 4 and 5 means that the refreshing roller 3 is driven by the fixing roller 1. In addition, peripheral speed-110 mm/sec in the comparison examples 6-9 and the specific examples 1-4, means that the refreshing roller 3 moves counterdirectionally relative to the fixing roller in the contact portion at 110 mm/sec. In addition, the peripheral speed of 440 mm/sec in a specific example 5 means that the refreshing roller 3 is rotated at sec in 440 mm/sec in the contact portion codirectionally relative to the fixing roller 1.

(Test Method)

The test method for the comparison and specific examples will be described. First, one thousand sheets (available from Canon Kabushiki Kaisha, Japan, high quality paper, A4R) for a color laser copying machine (registered Trademark) is supplied into above described fixing device longitudinally. The scratches are formed on the surface of the fixing roller 1 by the edge portions of the lateral ends (direction perpendicular to the feeding direction) of the high quality sheets. The basis weight of this high quality sheet is 80 g/m2. Coated sheet, namely, O.K. top coat 128 g/m2 (available from Shinoji Kabushiki Kaisha, A4) is fed widthwisely, and a uniform image of cyan half-tone gradation is formed. At the positions corresponding to the lateral ends of the A4R width on this image, the gloss non-uniformity attributable to the scratches (edge scratch) on the fixing roller by the edge portion is seen. The examinations were effected about whether the scratch (damaging scratch) used as an elimination degree by above described rubbing rotatable member and the problem on the image of this gloss non-uniformity produces. The surface roughness Rz of the edge scratch portion on the fixing roller 1 was 0.5 micrometer-2.0 micrometer, and even if the sheet processing operation was continues to the 100,000 sheets, the surface roughness did not increase. For this reason, the evaluation is carried out after 1000-sheet processing. In order to confirm the injurious effect, it was confirmed whether the foreign matters, such as dust, would stagnate upstream of the nip with respect to the direction of the surface movement of the fixing roller 1.

(Test Results)

Table 7 shows the results of above described tests.

TABLE 7

| | Gloss non-uniformity | Deffective damage | Foreign matter stagnation |
|---|---|---|---|
| Comp. Ex. 1 | x | x | x |
| Comp. Ex. 2 | x | x | x |
| Comp. Ex. 3 | ○ | x | x |
| Comp. Ex. 4 | x | ○ | ○ |
| Comp. Ex. 5 | ○ | ○ | ○ |
| Comp. Ex. 6 | ○ | x | ○ |
| Example 1 | ○ | ○ | ○ |
| Example 2 | ○ | ○ | ○ |
| Comp. Ex. 7 | x | ○ | ○ |
| Example 3 | ○ | ○ | ○ |
| Example 4 | ○ | ○ | ○ |
| Comp. Ex. 8 | ○ | x | ○ |
| Example 5 | ○ | ○ | ○ |
| Comp. Ex. 9 | ○ | x | ○ |

Figure 13:
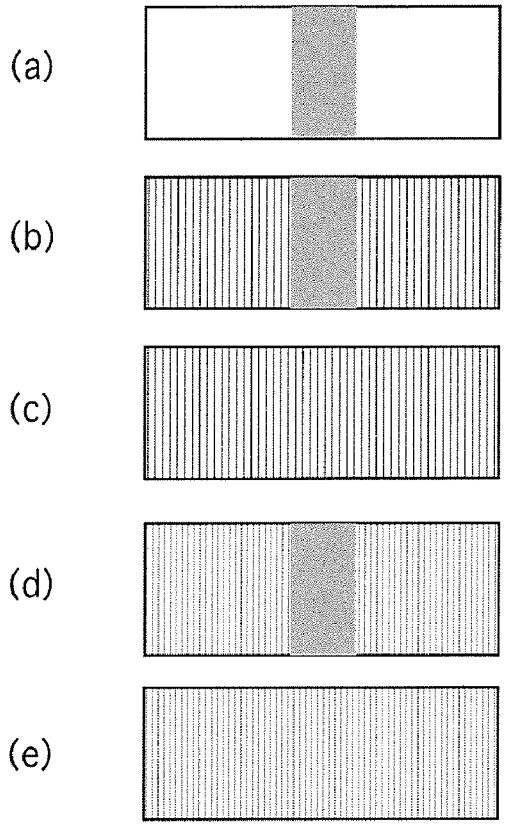
FIG. 13 is the schematic illustration of the state of the surface of the fixing roller before a rubbing operation, and the surface state of the fixing roller after the rubbing operation in the various conditions.

Gloss non-uniformity ○: No x: Yes
Deffective damage ○: No x: Yes
Foreign matter stagnation ○: No x: Yes In FIG. 13(*a*)-(*e*), the surface of the fixing roller 1 adjacent to the position corresponding to the edge portion is schematically shown. FIG. 13(*a*) shows the state of the surface of the fixing roller 1 before carrying out the rubbing operation. In this state, the gloss non-uniformity arises on the image. FIG. 13(*b*) shows the state where the scratches of the grade which is visible on the image along the direction of the surface movement of the fixing roller 1 by the rubbing operation are formed, and the difference in the roughness between the edge scratch portion and other portions remains. In this state, the gloss non-uniformity and the damaging scratch arise on the image. FIG. 13(*c*) shows the state having the formed scratches of the grade which is visible on the image along the direction of the surface movement of the fixing roller 1 by the rubbing operation, and the difference in the roughness between the edge scratch portion and the other portions is erased. In this state, the gloss non-uniformity does not arise on the image, but the damaging scratch arises. FIG. 13(*d*) shows the state where many fine scratches of the grade which is not visible on the image along the direction of the surface movement of the fixing roller 1 by the rubbing operation are formed, but the difference of roughness remains between the edge scratch portion and the other portions. In this state, the gloss non-uniformity arises on the image, but the damaging scratch is not produced. FIG. 13(*e*) shows the state where many fine scratches of the grade which is not visible on the image along the direction of the surface movement of the fixing roller 1 by the rubbing operation are formed, and the difference of the roughness between the edge scratch portion and other portions is erased. In this state, neither the gloss non-uniformity nor the damaging scratch is produced on the image.

The comparison examples 1 and 2 are the examples for investigating whether or not the edge scratch disappears by the cleaning web 200. in the oil application type and the oil-less type, the gloss non-uniformity on the image by the edge scratches does not disappear, and in addition, the damaging scratches are formed. The foreign matter from the outside stagnates during the rubbing operation.

From the result of the comparison example 3, the gloss non-uniformity on the image by the edge scratches disappeared in (with no rotation) only by the refreshing roller 3 contacted to the fixing roller 1, but the foreign matter stagnates and, moreover, the damaging scratch produces.

In the comparison example 4, in order to avoid the damaging scratch, the refreshing roller 3 was contacted to the fixing roller 1 and is driven by the fixing roller 1, but, the edge scratches did not disappear. The damaging scratches did not produce. The foreign matter from the outside did not stagnate in the rubbing operation.

In the comparison example 5, the time of the rubbing in the comparison example 4 was extended. Namely, in comparison example, the scratches were not able to be given to the fixing roller in the driven rotation of the comparison example 4, and therefore, in the comparison example 5 tried erasing edge scratches by extending the rubbing time, but the gloss non-uniformity on the image by the edge scratch did not disappear. However, the foreign matter did not stagnate and the damaging scratches were not produced, either.

As stated above, in the comparison examples 1-5, the contact of the cleaning web 200, the contact without the rotation of the refreshing roller 3, and the contact with driven rotation of the refreshing roller 3 were tried, but the result which can be satisfied in terms of both suppression of gloss non-uniformity and injurious effect production suppression is not obtained.

With comparison examples 6-9 and specific examples 1-5, the case where the refreshing roller 3 is rotated is investigated.

In the comparison examples 6 and 7 and the specific examples 1 and 2, the refreshing roller 3 is rotated so that the surface thereof moves counterdirectionally relative to the fixing roller 1 (counterdirectional drive) in the contact portion. The grit of abrasive grain 33A of the refreshing roller 3 is changed from #800 (coarse) to #1000, #4000, #6000 (fine).

As a result, the gloss non-uniformity on the image by the edge scratches was able to be erased in the comparison example 6 and the specific examples 1 and 2. However, in the comparison example 7, since the grit of abrasive grain 33A was too fine, the gloss non-uniformity on the image was not erased in some cases. In the comparison example 6, since the grit of abrasive grain 33A was too coarse, the damaging scratches produce in the fixing roller 1 in some cases. The damaging scratches did not produce in the specific examples 1 and 2 and the comparison example 7. By rotating the refreshing roller 3, the foreign matter did not stagnate. It is considered that by rotating the refreshing roller 3, the foreign matter entered from the outside into the nip of the refreshing roller 3 and the fixing roller 1 is discharged.

In the specific examples 3 and 4 and the comparison example 8, the pressure to the fixing roller 1 of the refreshing roller 3 is changed. The pressure is 20N in the total pressure in the comparison examples 1-7 and the specific examples 1 and 2, but in the specific examples 3 and 4 and the comparison example 8, the total pressure was changed to 10N, 100N, and 150N. As a result, in the specific examples 3 and 4, from the viewpoint of the suppression of the gloss non-uniformity and the injurious effect prevention, the results were satisfactory. In the comparison example 8, the suppression effect of the gloss non-uniformity is recognized. However, since the pressure was too large, the damaging scratches produce on the fixing roller 1.

In the specific example 5, the driving direction of the rotation of the refreshing roller 3 is changed. so that the movement direction of the surface thereof is codirectional with the fixing roller 1 in the contact portion. Then, the refreshing roller 3 was rotated with the peripheral speed twice the peripheral speed of the fixing roller 1. As a result, similarly to the case of above described counter drive, both of the gloss non-uniformity suppression effect and the injurious effect prevention effect were satisfactory.

In the comparison example 9, the case which carried out the counter drive of the refreshing roller 3 using the fixing roller of the oil application type was investigated. As a result, the effect which suppresses the gloss non-uniformity is recognized, however, since the surface layer of the fixing roller is too soft, the fixing roller can be scraped or shaved too much, and the damaging scratches produce.

As stated above, depending on the conditions of roughening the surface, the fine rubbing scratches are given to the fixing roller 1, by which the gloss non-uniformity attributable to the scratches by such edge portions, can be eliminated to such an extent that they are made invisible, and the damaging scratches on the image can be avoided.

(Surface of Fixing Roller)

The investigation has been made as to such desirable scratches. The results are shown in Table 8.

TABLE 8

| | Nature of damage | Surface roughness | Width | Density [No./100 μm] |
|---|---|---|---|---|
| Comp. Ex. 1 | Elongated | 2~5 μm | <50 μm | 1< |
| Comp. Ex. 2 | Elongated | 1~3 μm | <50 μm | 1< |
| Comp. Ex. 3 | Elongated | 1~3 μm | <50 μm | 1< |
| Comp. Ex. 4 | Hole | 0.5~1.0 μm | <1 μm | — |
| Comp. Ex. 5 | Hole | 0.5~1.0 μm | <1 μm | — |
| Comp. Ex. 6 | Elongated | 1.5~4 μm | <20 μm | 5< |
| Example 1 | Elongated | 1~2 μm | <10 μm | 10< |
| Example 2 | Elongated | 0.5~1.5 μm | <2 μm | 50< |
| Comp. Ex. 7 | Elongated | 0.5~1.0 μm | <1 μm | 100< |
| Example 3 | Elongated | 0.5~1.0 μm | <10 μm | 10< |
| Example 4 | Elongated | 1~2 μm | <10 μm | 10< |
| Comp. Ex. 8 | Elongated | 1.5~4 μm | <20 μm | 5< |
| Example 5 | Elongated | 0.5~1.5 μm | <2 μm | 50< |
| Comp. Ex. 9 | Elongated | 2~5 μm | <5 μm | 50< |

In the comparison examples 1-3, many scratches (longitudinal scratches) produce in the direction of the surface movement of the fixing roller 1, and the surface roughness Rz was 2 micrometers-5 micrometers in the fixing roller 1 of the oil application type, and Rz was 1 micrometer-3 micrometers in the fixing roller 1 of the oil-less type. The widths of the scratches of the oil application type and the oil-less type of were about 50 micrometers or less. The scratches were sparse and the number thereof was about one or more per 100 micrometers in the direction of axis of the fixing roller 1. The scratches are produced in the neighborhood of a position in which the foreign matter stagnated. It is thought that the foreign matter stagnated and the fixing roller 1 has been damaged because the cleaning web 200 or the refreshing roller 3 stops. Since they produce in both the cleaning web 200 and the refreshing roller 3, it is not dependent on the rubbing member and it is thought that the damaging scratches produce because the rubbing member stops.

The recesses in the form of a great number of holes are produced on the fixing roller 1 in the comparison examples 4 and 5. The surface roughness Rz is 0.5 micrometer-1.0 micrometers, and the width of the scratches are approx 1 micrometer or less. In these examples, the refreshing roller 3 is driven by the rotation of the fixing roller 1, and therefore, the free end apex configuration of abrasive grain 33A is impressed on the surface layer of the fixing roller 1. For this reason, there is no effect of making the edge scratches nonremarkable. Even if the time of the rubbing was increased to the 50 seconds, such the effect is not provided, but the number of the holes was increased a little. The scratches are shallow, and therefore, there is a possibility that above described effect can be provided by increasing the pressure or by extending the time of the rubbing. However, it is not avoided that the time of the rubbing required increases.

In the comparison examples 6 and 8, many scratches are produced in the direction of the surface movement of the fixing roller 1. The surface roughness Rz is 1.5 micrometers-4 micrometers, and the width of the scratches is about 20 micrometers or less. The number of the scratches is about five or more per 100 micrometers in axial direction of the fixing roller 1. The effect of making the edge scratches invisible is recognized, but the scratches and wide and deep, and therefore, the damaging scratches are produced, in some cases. In these examples, the scratches may be given too much.

In the comparison example 7, many scratches are produced in the direction of the surface movement of the fixing roller 1. The surface roughness Rz is 0.5 micrometer-1 micrometer, and the width of the scratches is about 1 micrometer or less. The number of the scratches is about 100 or more per 100 micrometers in axial direction of the fixing roller 1. There is no effect of making the edge scratches nonremarkable, in some cases. However, the scratches are thin and shallow, and therefore, the damaging scratches are not produced. In this example, the grade of the scratches may be too low.

Many scratches are produced in the direction of the surface movement of the fixing roller 1 in the specific examples 1 and 4. The surface roughness Rz is 1 micrometer-2 micrometers, and the width of the scratches is about 10 micrometers or less. The number of the scratches is about ten or more per 100 micrometers in axial direction of the fixing roller 1. The effect of making the edge scratches invisible is provided, and the damaging scratches are not produced.

Many scratches are produced in the direction of the surface movement of the fixing roller 1 in the specific examples 2 and 5. The surface roughness Rz is 0.5 micrometer-1.5 micrometers, and the width of the scratches is about 2 micrometers or less. The number of the scratches is about 50 or more per 100 micrometers in axial direction of the fixing roller 1. Also in these examples, the effect of making invisible the edge-scrapings is provided, and the damaging scratches are not produced.

In the specific example 3, many scratches are produced in the direction of the surface movement of the fixing roller 1. The surface roughness Rz is 0.5 micrometer-1.0 micrometers, and the width of the scratches is about 10 micrometers or less. The number of the scratches is about ten or more per 100 micrometers in axial direction of the fixing roller 1. The effect of making the edge scratches nonremarkable is recognized, and the damaging scratches are not produced.

As stated above, the conditions for the desirable scratches with which the edge scratches cannot be observed on the image and with which the edge scratches are nonremarkable are as follows. The surface roughness Rz is 0.5 micrometers or more and 2.0 micrometers or less on the fixing roller by the scratches provided by the rubbing operation, and the width of the scratches provided by abrasive grain is 10 micrometers or less, and the density of such scratches is ten or more per 100 micrometers in the rotation axial direction of the fixing roller. This rubbing scratch is less remarkable on the image with increase of a number thereof, but when a cost and an a durability of the refreshing roller are taken into account, the density is preferably considered as being 100 or less per 100 micrometers in the rotation axial direction of the fixing roller.

In this case, the surface roughness Rz on the image (toner portion on recording material S) is about 0.5 or less, and it has been confirmed that the surface roughness of this level is nonremarkable as the glossiness difference. In addition, about the density of the scratches, when several scratches are provided sparsely, it is easy to observe as the gloss stripe, but when it is provided by the high density (high frequency), the scratches are nonremarkable as the glossiness difference.

(Durability Test)

The durability test for confirming the durability of the surface layer of the fixing roller as to the specific examples 1 and 2 was carried out. In addition, in order to confirm the durability of a silicone rubber surface layer of the fixing roller of the oil application type, similar durability test was carried out also about the comparison example 9.

The lifetime of the fixing roller is 300,000 sheets. The rubbing operation is carried out for 5 seconds every 1000 sheet processing. In this case, the number Nt of the rubbing operations to the end of the lifetime of the fixing roller, is.

$$Nt = 300{,}000 \text{ sheets} / 1000 \text{ sheets}.$$
$$= 300.$$

The total rubbing time T to the end of the lifetime of the fixing roller, is.

$$T = 5 \text{ seconds} \times 300 \text{ times}.$$
$$= 1500 \text{ seconds}.$$
$$= 25 \text{ minutes}.$$

The thickness of the initial PFA tube which is the surface layer of the fixing roller is 30 micrometers (specific examples 1 and 2). The thickness of the silicone rubber is 1 mm (comparison example 9). The continuous rubbing test for the 30 minutes to the substantial end of the lifetime of the fixing roller is carried out. In addition, actual machine test in which the rubbing operation is carried out for 5 seconds for every 1000-sheet sheet processing is carried out. These are carried out 3 times, respectively.

The results are shown in Table 9. Table 9 shows the difference relative to the initial thickness. The thickness of the PFA tube is measured using laser microscope VK8500 available from Kabushiki Kaisha KEYENCE ( ). On the other hand, the thickness of the silicone rubber cannot be measured by a laser microscope, and therefore, a part of rubber of the fixing roller were removed and this thickness is measured as the step between the rubber and the core metal.

TABLE 9

| | | Fist | Second | Third |
|---|---|---|---|---|
| Example 1 | Continuous rubbing test 30 min. | ±0 μm | +1 μm | −3 μm |
| | Actual machine test 300,000 sheets | −3 μm | ±0 μm | +2 μm |
| Example 2 | Continuous rubbing test 30 min. | −1 μm | +1 μm | −2 μm |
| | Actual machine test 300,000 | −3 μm | ±0 μm | +1 μm |
| Comp. Ex. 9 | Continuous rubbing test 30 min. | −72 μm | −90 μm | −98 μm |
| | Actual machine test 300,000 | −93 μm | −85 μm | −72 μm |

As will be understands from the result of the specific examples 1 and 2, in the continuous rubbing test and actual machine test, there is no tendency that the thickness of the PFA tube reduces. The scraped amount of the PFA tube is at most a level which cannot be measured, or at most a measurement error level. In addition, there is no substantial difference in the scraped amount between the specific example 1 and the specific example 2, and scraped powder is not observed, either.

In the comparison example 9, the thickness of the surface silicone rubber reduced about 70 micrometers-100 micrometers, and the scraped powder of the silicone rubber is observed around the refreshing roller 3.

This result shows that in the specific examples 1 and 2, the refreshing roller 3 scrapes unobservable amount from the surface of the PFA tube of the surface layer of the fixing roller, or it only roughens the surface of the PFA tube. On the other hand, the silicone rubber of the surface layer of the fixing roller in the comparison example 9 is clearly scraped off by the refreshing roller 3. This is the same as that of the conventional an abrasive functions in, such as the patent specification 1. The difference in the surface layer of the fixing roller between the specific examples 1 and 2 and the comparison example 9 is represented by the difference in the hardness of the surface layer thereof.

In addition, in actual machine test up to the 300,000 sheets, there was no deterioration, by the durability test, of the eliminating power against the gloss non-uniformity by the edge scratches. However, the result of additional actual machine test up to the 500,000 sheets showed the deterioration of some of the eliminating power of the gloss non-uniformity. This is considered as being because the durability of the PFA tube have reduced. However, it has a lifetime practically sufficient as the fixing roller.

(Setting of Fixing Device)

The setting of the fixing device preferable for the gloss non-uniformity suppression will be described on the basis of above described test result.

First, the microhardness of the surface layer of the fixing roller will be described.

Usually, the hardness of the surface of the fixing roller is measured using a hardness meters, such as ASKER-C, for example. It is unsuitable as the index of hardness against the scratches of the surface layer of the fixing roller. The hardness measured by a Vickers hardness tester is rather suitable, wherein a sufficiently hard wedge is impressed into the sample, and the hardness is defined from the depth thereof, the pressure thereof, and so on. This is considered to be suitable as the index of the hardness which resists the scratches.

For the measurement of the microhardness of the surface layer of the fixing roller, triboScope available from HYSITRON as shown in FIG. 5 is used, similarly to the measurement of the microhardness of the surface layer of the refreshing roller. The measuring probe for measuring the microhardness is the Berkovich chip (142.3 degrees). The low weight and the low displacement are used as compared with the common hardness meter, and therefore, this hardness is often called "nano hardness". The load at the time of the measurement is within the limits of 10 micro N-2000 micro N, and is preferably 20 micro N-600 micro N. Here, the load of a measurement using was 200 micro N. The pressure is increased to the load specified for 5 seconds, and the pressure is removed for 5 seconds. FIG. 6 shows a load curve at the time of the load of 50 micro N, but the same applies to the case of 200 micro N, and the peak point of the ordinate is 200 micro N in such a case. At this time, the hardness H is determined as follows.

$$H=P\max/A.$$

Here, Pmax is a maximum stress applied to a probe, and A is a contact area (area of the impressions) of the probe. In the case of the used probe, a contact area A is as follows.

$$A=24.5hc^2.$$

where hc is an amount of entering into the inside of the refreshing roller of the probe.

Two above described kinds of the microhardness of the surface layer of the fixing roller were measured. At the time of the load of 200 micro N, the hardness of the surface PFA tube was H=1.0 Gpa, and the hardness of the surface silicone rubber was H=0.02 Gpa.

Figure 7:
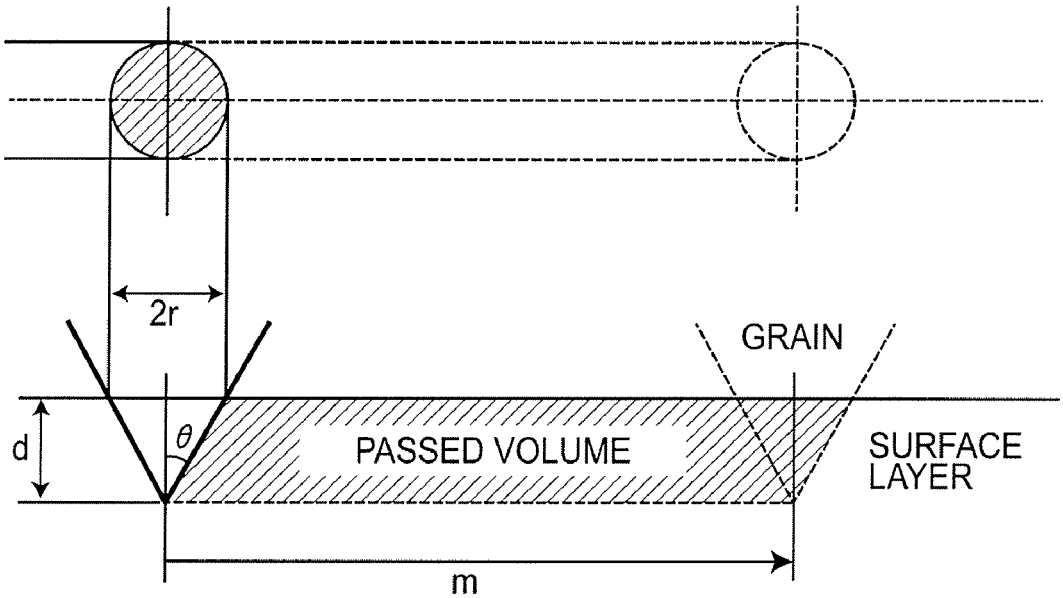
FIG. 7 is an illustration of a rubbing model by the refreshing roller.

Referring to FIG. 7, based on above described microhardness measuring method, a rubbing model of the fixing roller thought by the inventors will be described.

The diameter of the fixing roller is large enough as compared with that of abrasive grain (rubbing material) of the refreshing roller, and therefore, it is deemed that the surface layer of the fixing roller is smooth. It is deemed that the projection of abrasive grain of the refreshing roller is the conical which has half apex angle θ°, and the weight applied to this one abrasive grain is p N. Abrasive grain is impressed into the surface layer of the fixing roller which is soft as compared with abrasive grain by a weight p into depth d mm, and the impression radius at that time is r mm. microhardness of the fixing roller H GPa is as follows.

$$P=H, a\pi r2.$$

The volume removed through friction distance m (mm) by area rd (mm2) of the projection of the front of abrasive grain currently pushed in (amounts w of=wearing (mm3) are the following connoisseurs.).

$$w=rd\cdot m.$$

Since tan θ=r/d, $$w=r\cdot(r/\tan\theta)\cdot m$$

$$=r2(m/\tan\theta)$$

$$=(p/\pi H)(m/\tan\theta)$$

The peripheral speed of the fixing roller is V mm/sec and the peripheral speed of the refreshing roller is v mm/sec. The nip width of the rotational direction formed between the fixing roller and the refreshing roller is n mm. When a peripheral speed V of the fixing roller is a positive value, the sign of the peripheral speed v of the refreshing roller is as follows: When the directions of the surface movement in the contact portion (rubbing portion) between the fixing roller and the refreshing roller are the same as that of the fixing roller, it is positive; and when the direction is opposite, it is negative.

In the case of the structure according to this embodiment, the friction distance m is the distance which the one abrasive grain passes at the rate of peripheral speed difference |V−v| for time n/V in which one point on the fixing roller passes the nip, and therefore, $$m=(n/V)\cdot|V-v|.$$

Then, amount w of wearing.

$$w=(p/\pi H)(n/\tan\theta)(|V-v|/V),$$

Where w is amount of wearing per abrasive grain.

Total amount, in the inside of the nip between the refreshing roller and the fixing roller, of wearing W mm3 is considered. When a total weight is P N, and the number of abrasive grains contacted by the contact portion (nip) between the refreshing roller and the fixing roller is N, $$W=w\cdot N.$$

$$P=p\cdot N.$$

From this, the total amount W of wearing of the contact portions (nip) between the refreshing roller and the fixing roller are as follows:

$$W=(p/\pi H)\cdot(n/\tan\theta)\cdot(|V-v|/V)\cdot N.$$

$$=(P/\Pi H)(n/\tan\theta)(|V-v|/V).$$

The amount of wearing of the outer periphery of the fixing roller per a unit length is ω. W is amount of wearing in the inside of the contact portion (nip) between the refreshing roller and the fixing roller, and therefore, ω is obtained by dividing it by the contact (nip) width n. Namely, $$\omega=W/n.$$

$$=(P/\pi H\tan\theta)(|V-v|/V)[\text{mm3/mm}].$$

The outer diameter of the fixing roller is R, so the outer periphery thereof is πR. Then, the total amount Wtotal of wearing of one full circumference on the fixing roller is.

$$Wtotal=\omega\cdot\pi R.$$

$$=(PR/H\tan\theta)(|V-v|/V).$$

Amount ω of wearing per unit length is proportional to the total weight (pressure) P between the refreshing roller and the fixing roller and a peripheral speed ratio |V−v|/V, and is in inverse proportion to the microhardness H of the fixing roller, and the angle θ at the free end of abrasive grain (half apex angle).

When the fine rubbing scratches are given on the fixing roller to reduce the edge scratches, the length of the scratches is a parameter of the peripheral speed ratio |V−v|/V. The density, with respect to the longitudinal direction, of the scratches is a function of the number of abrasive grains and the grit (particle size) of abrasive grain. The depth of the scratches is a function of Total weight P, the microhardness H of the fixing roller, and the number of abrasive grains.

Table 10 shows the feature and the parameter of the scratches (recess) formed on the fixing roller.

TABLE 10

| Characteristics of damage | Parameter |
|---|---|
| Length | Nip width, Peripheral speed difference |
| Density in longitudinal direction | No. of particles, grit (particle size) |
| Depth | Refresh roller load, microhardness of fixing roller, No. of particles |

Amount ω of wearing per unit length is not a parameter of the number of abrasive grains and the grit (particle size) of abrasive grain, but, this is rather a parameter about nature of the rubbing scratches on the fixing roller.

When the fine rubbing scratches are given on the fixing roller, abrasive grain on the refreshing roller is preferably bonded uniformly without gap. For this reason, the number of abrasive grains and the particle size (grit) of abrasive grain are decided uniquely. For example, when the length of the refreshing roller is L and abrasive grain of an impression diameter r is bonded without gap on the refreshing roller, the number of abrasive grains in the longitudinal direction is L/2r. In the case of this example, in order to provide the scratches of the surface layer of the fixing roller which is not observed on the image, the preferable grit of abrasive grain was #1000-#4000. Namely, in average particle size, they are preferably about 3 micrometers-16 micrometers.

Angle at the free end of abrasive grain has variation within a certain amount of distribution. In an ordinary alumina abrasive grain used in this example, the half apex angle is approx. 30 degrees (60 degrees in full apex angles) on average.

Amount ω of wearing, per unit length, on the outer periphery of the fixing roller by this a model is calculated for every above described a test conditions.

Table 11 shows the results of this calculation.

Here, in the calculation, θ=30 degrees and tan 30°=0.7.

TABLE 11

| | Pressure [N] | Peripheral speed ration \|V − v\|/V | Microhardness H[GPa] | Wearing per unit length ω[10 − 3 mm3/mm] |
|---|---|---|---|---|
| Comp. Ex. 3 | 20 | 1 | 1 | 9 |
| Comp. Ex. 4 | 20 | 0 | 1 | 0 |
| Comp. Ex. 5 | 20 | 0 | 1 | 0 |
| Comp. Ex. 6 | 20 | 1.5 | 1 | 14 |
| Example 1 | 20 | 1.5 | 1 | 14 |
| Example 2 | 20 | 1.5 | 1 | 14 |

TABLE 11-continued

| | Pressure [N] | Peripheral speed ration \|V − v\|/V | Microhardness H[GPa] | Wearing per unit length ω[10 − 3 mm3/mm] |
|---|---|---|---|---|
| Comp. Ex. 7 | 20 | 1.5 | 1 | 14 |
| Example 3 | 10 | 1.5 | 1 | 7 |
| Example 4 | 100 | 1.5 | 1 | 68 |
| Comp. Ex. 8 | 150 | 1.5 | 1 | 102 |
| Example 5 | 20 | 1 | 1 | 9 |
| Comp. Ex. 5 | 20 | 1.5 | 0.02 | 682 |

The cleaning web is used as the rubbing rotatable member in the comparison examples 1 and 2, and therefore, this model does not apply, and for this reason, the calculation has not been carried out.

From above described result the durability reduction of the fixing roller can be suppressed, while suppressing the gloss non-uniformity produced on the image, in the following range of amount of wearing, $$7\times10^{-3}\ mm^3/mm \leqq \omega \leqq 68\times10^{-3}\ mm^3/mm.$$

Namely, the weight of the refreshing roller to the fixing roller is P N, the peripheral speed of the fixing roller is V mm/sec, the peripheral speed of the refreshing roller is v mm/sec, the microhardness of the fixing roller is H GPa, and the half apex angle of abrasive grain is 0°. At this time, it is preferable to satisfy $7\times10^{-3}\ mm^3/mm \leqq \omega \leqq 68\times10^{-3}\ mm^3/mm$.

On the basis of this, by the rubbing operation of the refreshing roller on the surface of the fixing roller the recesses are formed at the rate of ten or more per 100 micrometers in the rotation axial direction, wherein the surface roughness Rz is 0.5 micrometers or more and 2.0 micrometers or less, and the recesses by abrasive grain have the width of not more than 10 micrometer.

It is desirable for the refreshing roller 3 to rotate. It is preferable that the grit of abrasive grain is #1000-#4000, namely, the particle size of abrasive grain is more than the particle size of the grit #4000, and is below the particle size of the grit #1000.

As has been described hereinbefore, the grit (particle size) of abrasive grain is the parameter relevant to the nature of the rubbing scratches given on the fixing roller. According to the investigation of the inventors, the rubbing scratches desired on the fixing roller may differ, depending on the conditions, such as the state of the edge scratches, i.e., the state of the flash of the recording sheet, and the kind (the high quality paper or the coated paper, for example) of recording material on which the image is required to form with suppressed gloss non-uniformity. In order to provide the stabilized gloss suppression effect and the stabilized suppression effect of the damaging scratches, it is preferable that the grit of abrasive grain of the refreshing roller is #1000-#4000, as described above. However, depending on the case, when the grit of abrasive grain of the refreshing roller is #800-#6000 (i.e., when average particle sizes are about 2 micrometers-20 micrometers), the satisfactory result may be obtained.

Under the condition of above described example of the test, above described range is satisfied with ω=9 in the comparison example 3, but the refreshing roller 3 does not rotate, and therefore, the scratches by the foreign matter stagnation may produce.

Under the condition of above described example of the test, above described range is satisfied with ω=14 in the comparison examples 6 and 7, but the grit of abrasive grain may be too (too coarse) small, or may be too large (too fine), and therefore, the desired scratches may be unable to be given to the fixing roller.

From the result of the durability test, it understands that no removed powder is observed, and the thickness of the PFA tube of the surface layer of the fixing roller is not reduced by the durability test. For this reason, in this embodiment, amount of wearing is not the scraped amount, and amount of wearing is roughened degree or amount. In above described model, the surface of the PFA tube of the surface layer of the fixing roller is only cut by acute angle abrasive grain cross-section, and the tube of abrasive grain in the cross-section is scraped off.

In this manner, in the present invention, since the degree or amount of roughening of the fixing roller surface is defined as the function of pressure P, the peripheral speed ratio |V−v|/V, the fixing roller microhardness H, and the half apex angle θ of abrasive grain, it is easy to increase the coarseness or finely roughen the fixing roller surface to the desired state.

By the investigation of the inventors, it is preferable that average particle size of the refreshing roller is 5 micrometers or more and 20 micrometers or less correspondingly to the No. of above described abrasive grain.

As stated above, in this embodiment, the fine rubbing scratches are given to the fixing roller, by which gloss non-uniformity on the image attributable to the scratches on the fixing roller by edge The present invention is not limited to above described embodiment. For example, the usage of the image heating device is not limited to the fixing device for fixing the toner image of the unfixed on the recording material. For example, the present invention can be used for the smoothness increasing apparatus or a glossiness increasing apparatus for increasing the smoothness and a glossiness of the image by carrying out the re-heating after fixing the toner image on the recording material. In this case, the effects similar to above are provided.

The examples for fixing the image by the member of the shape of the roller like the fixing roller or the pressing roller have been described, in the foregoing, but when the fixing process is effected by the member (fixing belt and pressing belt) of the shape of a belt, the present invention can be applied similarly.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 217595/2006 filed Aug. 9, 2006 which is hereby incorporated by reference.

What is claimed is:

1. An image heating apparatus comprising:

a heating rotatable member for heating an image on a recording material in a nip;

a nip forming member for cooperating with said heating rotatable member to form the nip; and a rubbing rotatable member for rubbing, by its rotation, said heating rotatable member, wherein said rubbing rotatable member has an elastic layer to provide a microhardness [GPa] of not less than 0.03 and not more than 1.0, and wherein said elastic layer has a thickness [μm] of not less than 20 and not more than 60, and a JIS-A hardness (°) of not less than 40 and not more than 70.

2. An apparatus according to claim 1, wherein said rubbing rotatable member includes a core metal, and a bonding layer on the core metal for bonding rubbing material for rubbing said heating rotatable member, and wherein the bonding layer functions as said elastic layer.

3. An apparatus according to claim 2, wherein said rubbing material comprises particles having a particle size of not less than 5 μm and not more than 20 μm.

4. An apparatus according to claim 1, wherein said rubbing material includes alumina abrasive grain.

5. An apparatus according to claim 2, wherein the following is satisfied, $$7\times10^{-3}\leqq(P/\pi H\tan\theta)(|V-v|/V)\leqq68\times10^{-3},$$

where

P: load [N] by said rubbing member to said heating rotatable member,

V: peripheral speed [mm/sec] of said heating rotatable member, v: peripheral speed [mm/sec] the of said rubbing member, H: microhardness [GPa] of said heating rotatable member, and θ: a half-apex-angle [°] of said rubbing material.

6. An apparatus according to claim 5, wherein said heating rotatable member includes a surface parting layer comprising fluorinated resin material.

* * * * *